US012098345B2

(12) United States Patent
Burrington et al.

(10) Patent No.: US 12,098,345 B2
(45) Date of Patent: Sep. 24, 2024

(54) POLYMERIC SURFACTANT COMPOUND

(71) Applicant: The Lubrizol Corporation, Wickliffe, OH (US)

(72) Inventors: James D. Burrington, Gates Mills, OH (US); James S. Puckace, Palm Harbor, FL (US); Alexander Sammut, Chardon, OH (US); Greg Garwood, Hudson, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 22 days.

(21) Appl. No.: 17/786,784

(22) PCT Filed: Dec. 17, 2020

(86) PCT No.: PCT/US2020/065616

§ 371 (c)(1),
(2) Date: Jun. 17, 2022

(87) PCT Pub. No.: WO2021/127183

PCT Pub. Date: Jun. 24, 2021

(65) Prior Publication Data

US 2023/0036692 A1 Feb. 2, 2023

Related U.S. Application Data

(60) Provisional application No. 62/949,676, filed on Dec. 18, 2019.

(51) Int. Cl.

| | |
|---|---|
| ***C10M 149/02*** | (2006.01) |
| ***C10M 169/04*** | (2006.01) |
| *C10N 20/00* | (2006.01) |
| *C10N 20/04* | (2006.01) |
| *C10N 30/00* | (2006.01) |
| *C10N 30/04* | (2006.01) |
| *C10N 40/04* | (2006.01) |
| *C10N 40/25* | (2006.01) |

(52) U.S. Cl.

CPC ..... *C10M 149/02* (2013.01); *C10M 169/041* (2013.01); *C10M 2203/003* (2013.01); *C10M 2217/06* (2013.01); *C10N 2020/04* (2013.01); *C10N 2020/071* (2020.05); *C10N 2030/04* (2013.01); *C10N 2030/42* (2020.05); *C10N 2030/43* (2020.05); *C10N 2030/45* (2020.05); *C10N 2040/042* (2020.05); *C10N 2040/045* (2020.05); *C10N 2040/25* (2013.01)

(58) Field of Classification Search

CPC ..... C10M 149/02; C10M 169/041; C10M 2203/003; C10M 2217/06; C10N 2020/04; C10N 2020/071; C10N 2030/04; C10N 2030/42; C10N 2030/43; C10N 2030/45; C10N 2040/042; C10N 2040/045; C10N 2040/25

See application file for complete search history.

(56) References Cited

U.S. PATENT DOCUMENTS

| | | | |
|---|---|---|---|
| 3,172,892 | A | 3/1965 | Le Suer |
| 3,197,405 | A | 7/1965 | Le Suer |
| 3,219,666 | A | 11/1965 | Norman |
| 3,316,177 | A | 4/1967 | Dorer, Jr. |
| 3,340,281 | A | 9/1967 | Brannen, Jr. |
| 3,351,552 | A | 11/1967 | Le Suer |
| 3,381,022 | A | 4/1968 | Le Suer |
| RE26,433 | E | 8/1968 | Le Suer |
| 3,433,744 | A | 3/1969 | Le Suer |
| 3,444,170 | A | 5/1969 | Norman et al. |
| 3,467,668 | A | 9/1969 | Gruber et al. |
| 3,501,405 | A | 3/1970 | Willette |
| 3,542,680 | A | 11/1970 | Le Suer |
| 3,576,743 | A | 4/1971 | Widmer et al. |
| 3,632,511 | A | 1/1972 | Liao |
| 3,634,515 | A | 1/1972 | Piasek et al. |
| 4,234,435 | A | 11/1980 | Meinhardt et al. |
| 4,741,848 | A | 5/1988 | Koch et al. |
| 4,863,623 | A | 9/1989 | Nalesnik |
| 5,534,170 | A | 7/1996 | Watts |
| 5,750,476 | A | 5/1998 | Nibert et al. |
| 5,840,662 | A | 11/1998 | Nibert et al. |
| 5,840,663 | A | 11/1998 | Nibert et al. |
| 6,107,257 | A | 8/2000 | Valcho et al. |
| 6,107,258 | A | 8/2000 | Esche, Jr. et al. |
| 6,117,825 | A | 9/2000 | Liu et al. |
| 6,153,565 | A | 11/2000 | Skinner et al. |

(Continued)

FOREIGN PATENT DOCUMENTS

| | | |
|---|---|---|
| CN | 102807471 | 12/2012 |
| EP | 0355895 B2 | 1/1991 |

(Continued)

*Primary Examiner* — Ellen M McAvoy
(74) *Attorney, Agent, or Firm* — Eryn Ace Fuhrer; Michael A. Miller

(57) ABSTRACT

The instant disclosure relates to a lubricant composition having an oil of lubricating viscosity, a polymeric surfactant compound that is an acylated polymer having a number average molecular weight of about 500 to about 50,000 where the polymer comprises a branched olefin having from 8 to 30 carbon atoms. The acylated polymer can further be reacted with an amine or alcohol to form an amide, imide, ester or combinations thereof. The present disclosure further relates to lubricant compositions that exhibit good dispersancy and viscometric performance.

26 Claims, No Drawings

(56) References Cited

U.S. PATENT DOCUMENTS

| | | | |
|---|---|---|---|
| 6,165,235 | A | 12/2000 | Kolp et al. |
| 6,281,179 | B1 | 8/2001 | Skinner et al. |
| 6,329,327 | B1 | 12/2001 | Tanaka et al. |
| 6,429,178 | B1 | 8/2002 | Skinner et al. |
| 6,429,179 | B1 | 8/2002 | Skinner et al. |
| 6,468,946 | B2 | 10/2002 | Vinci |
| 6,559,105 | B2 | 5/2003 | Abraham et al. |
| 6,914,037 | B2 | 7/2005 | Gatto |
| 7,009,072 | B2 | 3/2006 | Muir |
| 7,041,761 | B2 | 5/2006 | Halasa et al. |
| 7,238,650 | B2 | 7/2007 | Calder et al. |
| 7,285,516 | B2 | 10/2007 | Carrick et al. |
| 7,407,919 | B2 | 8/2008 | Wilk et al. |
| 7,615,519 | B2 | 11/2009 | Esche, Jr. et al. |
| 7,615,521 | B2 | 11/2009 | Eveland et al. |
| 7,651,987 | B2 | 1/2010 | Kocsis et al. |
| 7,655,739 | B1 | 2/2010 | McPhee et al. |
| 7,696,136 | B2 | 4/2010 | Migdal et al. |
| 7,727,943 | B2 | 6/2010 | Brown et al. |
| 7,741,258 | B2 | 6/2010 | Fujitsu et al. |
| 7,759,444 | B1 | 7/2010 | McPhee |
| 7,790,661 | B2 | 9/2010 | Covitch et al. |
| 7,807,611 | B2 | 10/2010 | Kocsis et al. |
| 7,868,114 | B1 | 1/2011 | McPhee |
| 7,868,115 | B1 | 1/2011 | McPhee |
| 7,951,211 | B2 | 5/2011 | Barton et al. |
| 8,048,976 | B2 | 11/2011 | McPhee |
| 8,083,814 | B2 | 12/2011 | Stevenson et al. |
| 8,148,306 | B2 | 4/2012 | Bartley et al. |
| 8,217,128 | B2 | 7/2012 | McPhee |
| 8,334,353 | B2 | 12/2012 | McPhee |
| 8,399,388 | B2 | 3/2013 | Campbell et al. |
| 8,557,753 | B2 | 10/2013 | Gieselman et al. |
| 8,592,543 | B2 | 11/2013 | McPhee et al. |
| 8,637,437 | B2 | 1/2014 | Gieselman et al. |
| 8,772,211 | B2 | 7/2014 | Kelley et al. |
| 8,790,426 | B2 | 7/2014 | Garcia et al. |
| 8,889,808 | B2 | 11/2014 | McPhee |
| 8,894,726 | B2 | 11/2014 | Fang et al. |
| 8,911,516 | B2 | 12/2014 | Grabarse et al. |
| 8,966,305 | B2 | 2/2015 | Branover et al. |
| 9,006,158 | B2 | 4/2015 | Lange et al. |
| 9,574,149 | B2 | 2/2017 | Fang et al. |
| 9,862,906 | B2 | 1/2018 | Ohler et al. |
| 10,035,968 | B2 | 7/2018 | Salomon |
| 10,294,439 | B2 | 5/2019 | Ohler et al. |
| 2005/0037897 | A1 | 2/2005 | Chen |
| 2005/0101497 | A1 | 5/2005 | Saathoff et al. |
| 2008/0113890 | A1 | 5/2008 | Moreton et al. |
| 2010/0081592 | A1 | 4/2010 | Kocsis et al. |
| 2010/0197536 | A1 | 8/2010 | Mosier et al. |
| 2011/0219674 | A1 | 9/2011 | Barbour et al. |
| 2011/0287988 | A1* | 11/2011 | Fisher ..... C07C 5/09 585/254 |
| 2012/0010112 | A1 | 1/2012 | Grabarse et al. |
| 2012/0025512 | A1 | 2/2012 | Moura |
| 2013/0133243 | A1 | 5/2013 | Roeger-Goepfert et al. |
| 2013/0225463 | A1 | 8/2013 | Hansch et al. |
| 2018/0201863 | A1 | 7/2018 | Mezger et al. |
| 2020/0010775 | A1* | 1/2020 | Ikari ..... C10M 169/04 |
| 2021/0230498 | A1* | 7/2021 | Delbridge ..... C10M 159/22 |

FOREIGN PATENT DOCUMENTS

| | | | |
|---|---|---|---|
| WO | 2004007652 | A1 | 1/2004 |
| WO | 2006015130 | A1 | 2/2006 |
| WO | 2007044820 | A1 | 4/2007 |
| WO | 2008014319 | A1 | 1/2008 |
| WO | 2008147704 | A1 | 12/2008 |
| WO | 2011095819 | A1 | 8/2011 |
| WO | 2011110860 | A1 | 9/2011 |
| WO | 2011141731 | A1 | 11/2011 |
| WO | 2011160081 | A1 | 12/2011 |
| WO | 2013017884 | A1 | 2/2013 |
| WO | 2013017886 | A1 | 2/2013 |
| WO | 2013017889 | A1 | 2/2013 |
| WO | 2013070503 | A1 | 5/2013 |

* cited by examiner

POLYMERIC SURFACTANT COMPOUND

CROSS REFERENCE TO RELATED APPLICATION

This application claims priority from PCT Application Serial No. PCT/US2020/065616 filed on Dec. 17, 2020, which claims the benefit of U.S. Provisional Application No. 62/949,676 filed on Dec. 18, 2019, both of which are incorporated in their entirety by reference herein.

FIELD

The instant disclosure relates to a lubricant composition of an oil of lubricating viscosity, a polymeric surfactant compound that is an acylated polymer where the polymer has a number average molecular weight of about 500 to about 50,000, and the polymer comprises a branched olefin having from 8 to 30 carbon atoms. The acylated polymer can further be reacted with an amine or alcohol to form an amide, imide, ester or combinations thereof. The present disclosure further relates to lubricant compositions that exhibit good dispersancy and viscometric performance.

BACKGROUND

Lubricating oil compositions used to lubricate a mechanical device contain a base oil of lubricating viscosity, or a mixture of such oils, and additives used to improve the performance characteristics of the oil. For example, additives are used, to improve detergency and dispersancy, to reduce wear, to provide stability against heat and oxidation, to reduce oil consumption, to inhibit corrosion, and to reduce friction loss, among other attributes. It is also desirable that a lubricating oil composition maintain a relatively stable viscosity over a wide range of temperatures. Viscosity improvers are often used to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved. However, each such additive is a separate component of the formulated lubricating oil and adds cost. It would be beneficial to have a single multi-functional additive that controls more than one performance characteristic of the lubricating oil without having an adverse effect on other properties of the lubricating oil such as a polymeric surfactant compound.

New lubricating compositions are formulated to meet higher automobile fuel economy standards, longer oil drain intervals, and greater operating severity. This need may require the use of even higher levels of additives and/or lower lubricant base stock viscosity. The use of higher levels of additives, however, may significantly increase the viscosity of lubricant compositions and render it difficult to attain lower motor oil viscosity grades, e.g., 0 W-8, 0 W-16, 0 W-20, and 0 W-30, Lower viscosity grades for motor oil are particularly important in meeting fuel economy guidelines.

Thus, there is a need for additives with effective deposit control and cleanliness with viscosity characteristics for use in low viscosity lubricating compositions.

BRIEF SUMMARY

The instant disclosure relates to a lubricant composition of an oil of lubricating viscosity and from 0.1 wt % to 20 wt % of a polymeric surfactant compound comprising an acylated polymer having a number average molecular weight of about 500 to about 50,000 Daltons (Da) and in which the polymer comprises a branched olefin having 8 to 30 carbon atoms In certain embodiments the polymer of the acylated polymer can be represented by formula:

$$-[T]_n-[Z]_m—$$

wherein,

[T] is a branched olefin of 8 to 30 carbon atoms and

[Z] is a vinyl monomer capable of polymerizing with the branched olefin and m is 0 to 100 wherein n is at least 1 or is at least 2 when m=0.

The stereoscopic arrangement of [Z] and [T] is linear, branched or cyclic; the sequential arrangement of [Z] and [T] is block, alternating or random; the molecular weight of the olefin copolymer is in the range of 500 g/mol to 50,000 g/mol.

In an embodiment, the branched olefin [T] can include at least one oligomer of a lower olefin having from 5 to 10 carbon atoms, and in some embodiments, the lower olefin with an additive mixture, wherein The additive mixture comprises a polymeric surfactant compound that is an acylated polymer comprising a polymer having a number average molecular weight of about 500 Da to about 50,000 Da, and comprises a branched olefin having from 8 to 30 carbon atoms, and One or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof.

Another aspect of the present disclosure is a process for formulating a lubricant, the process comprising combining an oil of lubricating viscosity with an additive mixture, wherein The additive mixture comprises polymeric surfactant compound that is an acylated polymer comprising a polymer having a number average molecular weight of about 500 Da to about 50,000 Da, and comprises a branched olefin having from 8 to 30 carbon atoms, and wherein the acylated polymer is further reacted with an amine or alcohol to form an amide, imide, ester or combinations thereof.

One or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof.

A further aspect of the technology relates to methods of lubricating a mechanical device, for example, by supplying to the device the lubricating composition described herein containing the grafted copolymer viscosity modifier. The mechanical device can be, for example, an internal combustion engine, an automotive driveline device, such as a transmission or an axle, or an off-highway vehicle. The technology could also be employed in industrial applications, such as industrial hydraulics.

DETAILED DESCRIPTION

The instant disclosure relates to lubricating compositions having an additive package and methods for lubricating a mechanical device. Lubricating compositions disclosed herein may include an oil of lubricating viscosity and from 0.1 wt % to 20 wt % of a polymeric surfactant compound that is an acylated polymer comprising a polymer having a number average molecular weight of about 500 to about 50,000, and comprises a branched olefin having from 8 to 30 carbon atoms. The acylated polymer can further be reacted with an amine or alcohol to form an amide, imide, ester or combinations thereof. The present disclosure further relates to lubricant blends that exhibit good dispersancy and viscometric performance Oils of Lubricating Viscosity One component of the disclosed technology is an oil of lubricating viscosity. As used herein, an oil of lubricating viscosity may include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). The cited portions of both references are incorporated herein. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Suitable oils may be produced from biological, i.e. natural, sources or by bio-engineered processes. This includes both natural occurring oils, such as vegetable oils and triglyceride oils that may be further refined or purified by standard processes, and those oils that may be derived by biological conversion of a natural chemical into oil directly or by bio-formation of building block pre-cursor molecules capable of being further converted into oil by known processes.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10), which are incorporated herein by reference.

In one embodiment the oil of lubricating viscosity may be an API Group I to IV mineral oil, an ester or a synthetic oil, or mixtures thereof. In one embodiment the oil of lubricating viscosity may be an API Group II, Group III, Group IV mineral oil, an ester or a synthetic oil, or mixtures thereof.

The amount of the oil of lubricating viscosity present is typically the balance remaining after subtracting from 100 wt % the sum of the amount of the dispersant additive package according to the instant disclosure and additional, if any, additives.

The lubricating composition may be in the form of a concentrate and/or a fully formulated lubricant. If the lubricating composition of the instant disclosure (comprising the dispersant additive package disclosed herein and, optionally, other additives) is in the form of a concentrate which may be combined with additional oil to form, in whole or in part, a finished lubricant, the ratio of these additives to the oil of lubricating viscosity and/or to diluent oil include the ranges of 1:99 to 99:1 by weight, or 80:20 to 10:90 by weight. Typically, the lubricating compositions comprises at least 50 wt %, or at least 60 wt %, or at least 70 wt %, or at least 80 wt % of an oil of lubricating viscosity.

In the present disclosure, the lubricating composition can include a base oil or an oil of lubricating viscosity having a kinematic viscosity measured at 100° C. of 2.4 $m^2/s$ to 6.4 $m^2/s$. In some embodiments, the kinematic viscosity is from 4.0 $m^2/s$ to 5.0 $m^2/s$ or from 5.2 $m^2/s$ to 5.8 $m^2/s$ or from 6.0 $m^2/s$ to 6.5 $m^2/s$. In other embodiments, the kinematic viscosity is 6.2 $m^2/s$ or 5.6 $m^2/s$ or 4.6 $m^2/s$.

The lubricating composition claimed herein may be in the form of a concentrate and/or a fully formulated lubricant. If the lubricating composition is in the form of a concentrate (which may be combined with additional oil to form, in whole or in part, a finished lubricant), the ratio of the components disclosed herein to the oil of lubricating viscosity and/or to diluent oil include the ranges of 1:99 to 99:1 by weight, or 80:20 to 10:90 by weight.

The Polymeric Surfactant Compound

Another component of this disclosure relates to a polymeric surfactant compound that is an acylated polymer comprising a polymer having a number average molecular weight of about 500 Da to about 50,000 Da, or 2000 Da to about 50,000 Da, or about 2000 Da to about 40,000 Da, or 2000 Da to about 30,000 Da or about 2,000 Da to about 20,000 Da or about 5,000 Da to about 20,000 Da and the polymer comprises a branched olefin having from 8 to 30 carbon atoms. It is also contemplated that the polymeric surfactant compound is the reaction product of the acylated polymer with an amine or alcohol to form an amide, imide, ester, or combination thereof.

The polymer of the of the acylated polymer can be represented by formula:

$$-[T]_n-[Z]_m—$$

wherein,

[T] is a branched olefin of 8 to 30 carbon atoms and

[Z] is a vinyl monomer capable of polymerizing with the branched olefin and m is 0 to 100 wherein n is at least 1 or is at least 2 when m=0.

The stereoscopic arrangement of [Z] and [T] is linear, branched or cyclic; the sequential arrangement of [Z] and [T] is block, alternating or random; the molecular weight of the polymer is in the range of 500 g/mol to 50,000 g/mol or about 2000 g/mol to about 40,000 g/mol, or about 2000 g/mol to about 30,000 g/mol, or 2000 g/mol to about 20,000 g/mol about 5,000 g/mol to about 20,000 g/mol.

The branched olefin can comprise, consist essentially of, or consist of at least one oligomer, and the at least one oligomer itself can comprise, consist essentially of, or consist of lower olefins of 5 to 10 carbon atoms. A lower olefin, as used herein, refers to an alkyl chain having at least one double bond and at least one tertiary carbon atom. Without limiting the branched olefin, examples of such lower olefins can be represented by the following example olefin formulas:

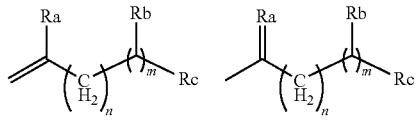

-continued

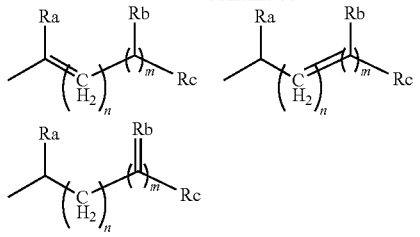

where Ra, Rb, and Rc can be H or a lower $C_1$ to $C_5$ alkyl group with the proviso that at least on of Ra or Rb is a lower C1-C5 alkyl group; n and m can be, independently, integers of 0 to 6, with the proviso that n+m is from 1 to 6; and the lower olefin has from 5 to 10 carbon atoms. An oligomer of such lower olefins could be, for example, oligomers of the following formula:

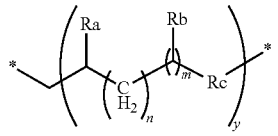

where Ra, Rb, Rc, m and n are as above, and y is an integer of 2 to 6, or 2 to 4, or 2 to 3 or 3.

The lower olefin can also be a polyene. That is, the branched olefin can comprise, consist essentially of, or consist of at least one oligomer, and the at least one oligomer itself can comprise, consist essentially of, or consist of lower olefins of 5 to 10 carbon atom polyene compound. As used herein a "polyene" is a poly-unsaturated alkylene compound having at least 2 double bonds (also known as a diene), and in some cases 3 or 4 double bonds.

The polyene compound can be described as an alkyl chain having at least two double bonds in the chain, and at least one tertiary carbon atom. Although the polyene compound may include more than 2 double bonds, an example polyene compound may be a branched conjugated diene represented by the following formula:

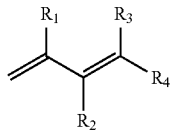

where $R_1$, $R_2$, $R_3$, and $R_4$ are independently H, or lower $C_1$ to C5 alkyl groups; with the proviso that at least one of $R_1$, $R_2$, $R_3$, and $R_4$ is an alkyl group and that taken together the conjugated diene has a total of from 5 to 10 carbon atoms.

The at least one branched olefin can be oligomerized from 5 to 10 carbon atom branched lower olefins or branched lower polyenes, or the branched olefin may be prepared in some other manner. For example, the branched olefin may be formed by 1,2-monomer addition or 1,4-monomer addition. In one embodiment, oligomers of 5 to 10 carbon atom lower polyenes may be formed by 1,4-addition of the monomers, followed by partial hydrogenation of the resulting material to form a branched olefin. The branched olefin may also be produced via biological activity, such as through the fermentation of a cell culture system that is capable of producing the desired branched olefin or a composition having the appearance of an oligomer containing monomers equivalent to 5 to 10 carbon atom lower olefin or lower polyene compounds. For instance, WO 2011/160081 provides a biological pathway for the production of isoprene, and the use of the so-produced isoprene to produce oligomers (also called terpenes, i.e., having a formula of $(C_5H_8)_n$, where n is 2, 3, 4, 5 or higher). The hydrocarbyl group may also be derived from an alkylating agent produced from a biological pathway, including, for instance, a biological pathway for the production of natural phytol from the crude extraction of silkworm excrement, Morns alba leaf, bamboo leaf, pine needle and *Ginkgo biloba* leaf, for example as taught in CN 102807471 A Dec. 5, 2012. Other biological pathways are known to produce the oligomers (e.g., terpenes) themselves.

A branched olefin containing 5 to 10 carbon atom lower olefins could be, for example, oligomers of the following formula:

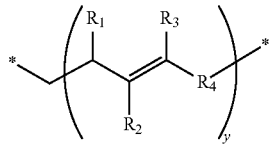

where R1, R2, R3, and R4 and y are the same as defined above.

The 5-10 carbon atom lower olefin of the branched olefin may include isoprene of Formula IV:

Formula IV

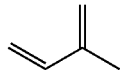

In addition to isoprene, suitable lower olefins include 2-methyl-1-butene, 3-methyl-1-butene, 4-methyl-1-pentene, 2-methyl-1-pentene, 3-methyl-1-pentene, 2-methyl-1-hexene, 3-methyl-1-hexene, 5-methyl-1-hexene, 4-methyl-1-hexene, 2-methyl-1-heptene, 2,3-dimethyl-1,3-butadiene, 2,4-dimethyl-1,3-pentadiene, 3-methyl-1,3-pentadiene, and mixtures thereof.

In an embodiment, the branched olefin contains units equivalent to isoprene.

An isoprene oligomer containing 15 to 30 carbon atoms would contain 3 to 6 isoprene monomer units. An isoprene oligomer containing 10 to 15 carbon atoms would contain 2 or 3 isoprene monomer units.

The branched olefin [T] can have one or more of formula (1) to (8):

1

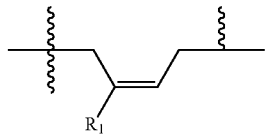

-continued

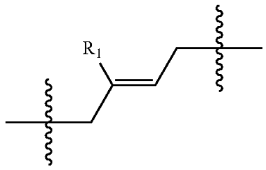

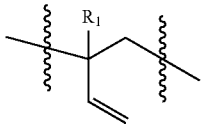

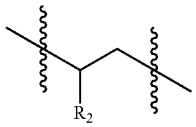

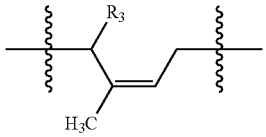

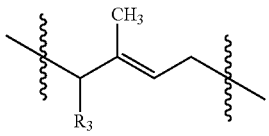

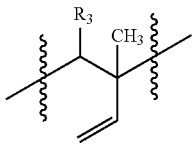

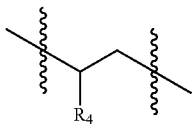

wherein $R_1$ has formula (9)

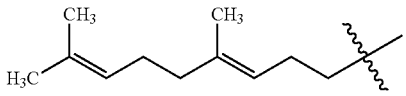

$R_2$ has formula (10)

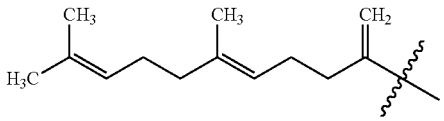

$R_3$ has formula (11)

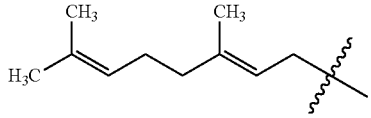

$R_4$ has formula (12)

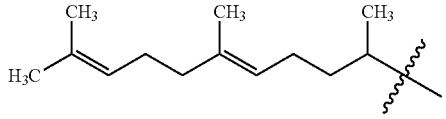

In an embodiment, the branched olefin is a trimer of isoprene, which can be envisioned in the following forms:

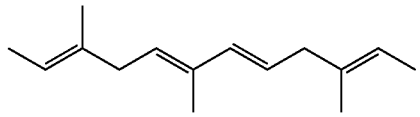

(2E,5E,7E,10E)-3,6,10-trimethyldodeca-2,5,7,10-tetraene

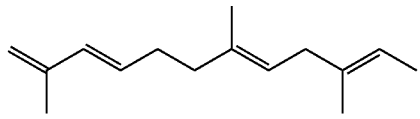

(3E,7E,10E)-2,7,10-trimethyldodeca-1,3,7,10-tetraene

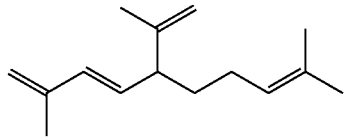

(E)-2,9-dimethyl-5-(prop-1-en-2-yl)deca-1,3,8-triene

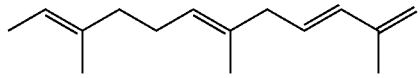

(3E,6E,10E)-2,6,10-trimethyldodeca-1,3,6,10-tretraene

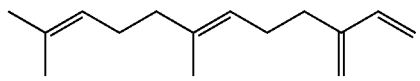

(E)-7,11-dimethyl-3-methylenedodeca-1,6,10-triene

Tetramers of isoprene may also be employed in the branched olefin, and can be envisioned in the following forms:

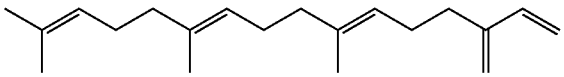

(6E,10E)-7,11,15-trimethyl-3-methylenehexadeca-1,6,10,14-tetraene

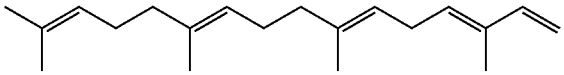

(3E,10E,14E)-3,7,11,15-tetramethylhexadeca-1,3,6,10,14-pentaene

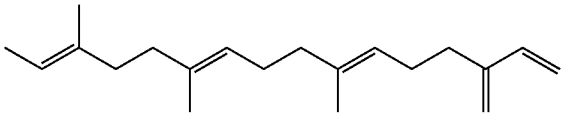

(6E,10E,14E)-7,11,14-trimethyl-3-methylenehexadeca-1,6,10,14-tetraene

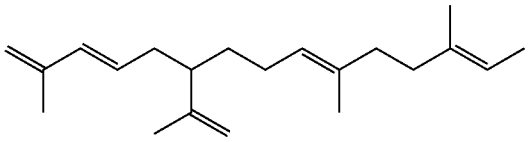

(6E,9E,13E)-2,10,13-trimethyl-6-(prop-1-en-2-yl)pentadeca-1,3,9,13-tetraene

In one embodiment, the branched olefin group of the polymer can comprise, consist essentially of, or consist of lower olefins comprising, consisting essentially of, or consisting of at least 50 mol % lower olefins equivalent to isoprene, at least 75 mol % lower olefins equivalent to isoprene, or at least 90 mol % lower olefins equivalent to isoprene. In one embodiment, the branched olefin consists of isoprene units.

In some embodiments, the branched olefin can be hydrogenated. Hydrogenation may be performed, for example, by any hydrogenating agent known to a skilled artisan. For example, a partially hydrogenated oligomer of lower olefin polyene compounds can be prepared by hydrogenating at least a portion of the double bonds in the branched olefin in the presence of a hydrogenation reagent, such as hydrogen in the presence of a catalyst, or by treatment with hydrazine in the presence of a catalyst.

In some embodiments, the polymer is a homopolymer, an interpolymer or a combination thereof. In certain embodiments, the polymer is a homopolymer of a lower olefin comprising units derived from at least one lower olefin having 5 to 10 carbon atoms such as terpenes. In other embodiments, the polymer is an interpolymer of a branched olefin comprising units derived from at least one lower olefin having 5 to 10 carbon atoms such as terpenes and at least one co-polymerizable vinyl monomer. In further embodiments, the polymer is derived from styrene and at least one branched olefin comprising units derived from at least one lower olefin having 5 to 10 carbon atoms such as terpenes. In still further embodiments, the polymer is a random, block or alternating interpolymer. In still further embodiments, the polymer is a di-block, tri-block or other multi-block interpolymer.

In certain embodiments, the polymer is prepared by polymerizing β-farnesene catalyzed in the presence of any catalyst suitable for polymerizing olefins. In other embodiments, the polymer is the homopolymer of 0-farnesene and comprises one or more units having formula (1), (2), (3), (4), a stereoisomer thereof or a combination thereof:

1

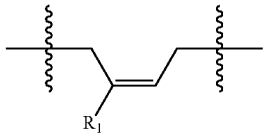

2

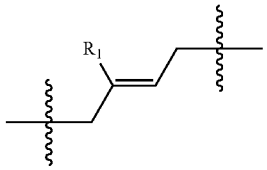

3

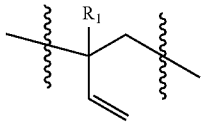

4

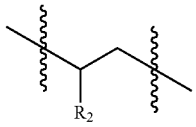

wherein $R_1$ has formula (9)

9

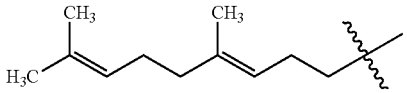

$R_2$ has formula (10)

10

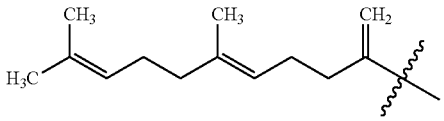

In certain embodiments, the polymer is prepared by polymerizing α-farnesene in the presence of any catalyst suitable for polymerizing olefins. In other embodiments, the polymer is the homopolymer of α-farnesene and comprises one or more units having formula (5), (6), (7), (8), a stereoisomer thereof or a combination thereof:

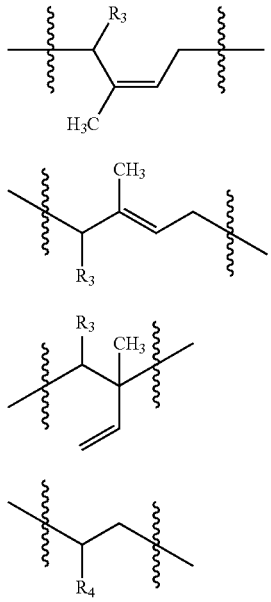

$R_3$ has formula (11)

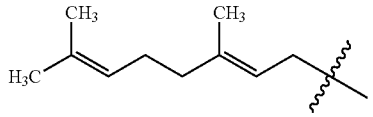

$R_4$ has formula-(12)

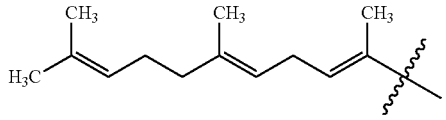

In some embodiments, the polymer is prepared by polymerizing a mixture of α-farnesene and β-farnesene in the presence of any catalyst suitable for polymerizing olefins. In other embodiments, the polymer comprises one or more units having formula (1), (2), (3), (4), (5), (6), (7) or (8) disclosed herein, a stereoisomer thereof or a combination thereof. In further embodiments, the one or more units having formula (1), (2), (3), (4), (5), (6), (7) or (8) in the olefin copolymer can be in any order.

In some embodiments, the polymer comprises two or more units having two different formulae selected from formulae (1), (2), (3), (4), (5), (6), (7) or (8) stereoisomers thereof and combinations thereof. In other embodiments, such polymer can be represented by the following formula: $A_xB_y$ wherein each of x and y is at least 1, and wherein each of A and B independently has formulae (1), (2), (3), (4), (5), (6), (7) or (8) and A and B are different. In a further embodiment, each of x and y is independently greater than 1, such as 2, 3, 4, 5, 6, 7, 8, 9, 10, 15, 20, 25, 30, 35, 40, or higher. In some embodiment, the As and Bs are linked in a substantially linear fashion, as opposed to a substantially branched or substantially star-shaped fashion. In other embodiments, the As and Bs are randomly distributed along the polymer chain. In other embodiments, the As and Bs are in two "segments" to provide a polymer having a segmented structure, for example, AA--A-BB---B. In other embodiments, the As and Bs are alternatively distributed along the polymer chain to provide a polymer having an alternative structure, for example, A-B, A-B-A, A-B-A-B, A-B-A-B-A or the like.

In some embodiments, the polymer comprises three or more units having three different formulae selected from formulae (1), (2), (3), (4), (5), (6), (7) or (8) stereoisomers thereof and combinations thereof. In other embodiments, such polymer can be represented by the following formula: $A_xB_yC_z$ wherein each of x, y and z is at least 1, and wherein each of A, B and C independently has formulae (1), (2), (3), (4), (5), (6), (7) or (8) and A, B and C are different. In a further embodiment, each of x, y and z is independently greater than 1, such as 2, 3, 4, 5, 6, 7, 8, 9, 10, 15, 20, 25, 30, 35, 40, or higher. In some embodiment, the As, Bs and Cs are linked in a substantially linear fashion, as opposed to a substantially branched or substantially star-shaped fashion. In other embodiments, the As, Bs and Cs are randomly distributed along the polymer chain. In other embodiments, the As, Bs and Cs are in three "segments" to provide an polymer having a segmented structure, for example, AA--A-BB-B-CC--C. In other embodiments, the As, Bs and Cs are alternatively distributed along the polymer chain to provide a polymer having an alternative structure, for example, A-B-C-A-B, A-B-C-A-B-C or the like.

In certain embodiments, the polymer is an interpolymer. In other embodiments, the polymer is prepared by polymerizing at least one branched olefin comprising lower olefins/lower polyenes having 5 to 10 carbon atoms such as terpenes and at least one vinyl monomer having formula (13) in the presence of any catalyst suitable for polymerizing olefins and vinyl monomers. In further embodiments, the polymer disclosed herein comprises (a) one or more units having at least one of formulae (1), (2), (3) and (4) disclosed herein; and (b) one or more units having formula (13):

13

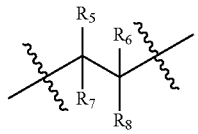

wherein each of $R_5$, $R_6$, $R_7$ and $R_8$ is independently H, or a hydrocarbyl group containing 1-24 carbon atoms. In some embodiments, each of $R_5$, $R_6$, $R_7$ and $R_8$ is an alkyl group containing 1-24 carbon atoms or is an aromatic group defined by Huckel theory of 4n+2 π electrons per ring system having 6 to 12 carbon atoms. In an embodiment at least one of $R_5$, $R_6$, $R_7$ $R_8$ is a phenyl group.

In some embodiments, the polymer disclosed herein comprises (a) one or more units having at least one of formulae (5), (6), (7) and (8) disclosed herein; and (b) one or more units having formula (13) disclosed herein. In other embodiments, the polymer disclosed herein comprises (a) one or more units having at least one of formulae (1), (2), (3), (4), (5), (6), (7) or (8) disclosed herein; and (b) one or more units having formula (13) disclosed herein.

In some embodiments, the polymer disclosed herein is a random interpolymer. In other embodiments, the polymer disclosed herein is a random interpolymer wherein the vinyl monomer units and the branched olefin units are randomly distributed. In further embodiments, the polymer disclosed herein is a random interpolymer wherein the vinyl monomer units and the branched olefin are randomly distributed and wherein two or more of formulae (1), (2), (3), (4), (5), (6), (7), and (8) in the branched olefin units are distributed randomly, alternatively or in blocks.

In some embodiments, the polymer disclosed herein is an alternating interpolymer. In other embodiments, the polymer disclosed herein is an alternating interpolymer wherein the vinyl monomer units and branched olefin units are alternatively distributed. In further embodiments, the polymer disclosed herein is an alternating interpolymer wherein the vinyl monomer units and branched olefin units are alternatively distributed and wherein two or more of formulae (1), (2), (3), (4), (5), (6), (7), and (8) in the branched olefin units are distributed randomly, alternatively or in blocks.

In certain embodiments, the polymer is a block interpolymer having one or more first blocks comprising the one or more units having formula (1), (2), (3), (4) or a combination thereof and one or more second blocks comprising the one or more units having formula (13). In further embodiments, the polymer is a block interpolymer having one or more first blocks comprising the one or more units having formula (5), (6), (7), (8) or a combination thereof and one or more second blocks comprising the one or more units having formula (13). In still further embodiments, there are one first block and two second blocks and wherein the first block is between the two second blocks. In still further embodiments, each of the second blocks comprises units derived from styrene. In some embodiments, the branched olefin block interpolymer is a di-block, a tri-block or a combination thereof.

In some embodiments, the olefin copolymer can be represented by the following formula: $P_xQ_y$ wherein each of x and y is at least 1, and wherein P has formula (13) and Q has formula (1), (2), (3), (4), (5), (6), (7) or (8). In further embodiment, each of x and y is independently greater than 1, such as 2, 3, 4, 5, 6, 7, 8, 9, 10, 15, 20, 25, 30, 35, 40, or higher. In some embodiment, the Ps and Qs are linked in a substantially linear fashion, as opposed to a substantially branched or substantially star-shaped fashion. In other embodiments, the Ps and Qs are randomly distributed along the polymer chain. In other embodiments, the Ps and Qs are in two or more blocks or segments to provide an interpolymer having a block structure, for example, PP--P-QQ---Q or PP--P-QQ---Q-P---PP. In other embodiments, the Ps and Qs are alternatively distributed along the polymer chain to provide an interpolymer having an alternative structure, for example, P-Q, P-Q-P, P-Q-P-Q, P-Q-P-Q-P or the like. In some embodiments, each Q has formula $A_xB_y$ or $A_xB_yC_z$ as disclosed herein.

In certain embodiments, the amount of formula (1) in the polymer disclosed herein is at most about 85 wt. %, at most about 80 wt. %, at most about 70 wt. %, at most about 60 wt. %, or at most about 50 wt. %, based on the total weight of the polymer. In other embodiments, the amount of formula (3) in the polymer disclosed herein is at least about 10 wt. %, at least about 15 wt. %, at least about 20 wt. %, at least about 25 wt. %, at least about 30 wt. %, at least about 40 wt. %, at least about 50 wt. %, at least about 60 wt. %, at least about 70 wt. %, at least about 80 wt. %, at least about 90 wt. %, at least about 95 wt. %, or at least about 99 wt. %, based on the total weight of the polymer. In further embodiments, the amount of formula (2) in the polymer disclosed herein is from about 1 wt. % to about 99 wt. %, from about 5 wt. % to about 99 wt. %, from about 10 wt. % to about 99 wt. %, or from about 15 wt. % to about 99 wt. %, based on the total weight of the polymer. In still further embodiments, the amount of formula (4) in the polymer. disclosed herein is at most about 0.1 wt. %, at most about 0.5 wt. %, at most about 1 wt. %, at most about 2 wt. %, or at most about 3 wt. %, based on the total weight of the polymer. In some embodiments, the polymer. disclosed herein is substantially free of formula (1), (2), (3) or (4).

In certain embodiments, the amount of formula (5), (6), (7) or (8) in the polymer. disclosed herein is at most about 1 wt. %, at most about 5 wt. %, at most about 10 wt. %, at most about 20 wt. %, at most about 30 wt. %, at most about 40 wt. %, at most about 50 wt. %, at most about 60 wt. %, at most about 70 wt. %, at most about 80 wt. %, or at most about 90 wt. %, based on the total weight of the polymer. In other embodiments, the amount of formula (5), (6), (7) or (8) in the polymer. disclosed herein is at least about 1 wt. %, at least about 2 wt. %, at least about 3 wt. %, at least about 5 wt. %, at least about 10 wt. %, at least about 20 wt. %, at least about 30 wt. %, at least about 40 wt. %, at least about 50 wt. %, at least about 60 wt. %, based on the total weight of the polymer. In further embodiments, the amount of formula (5), (6), (7) or (8) in the polymer. disclosed herein is from about 1 wt. % to about 99 wt. %, from about 5 wt. % to about 99 wt. %, from about 10 wt. % to about 99 wt. %, or from about 15 wt. % to about 99 wt. %. based on the total weight of the polymer. In some embodiments, the polymer. disclosed herein is substantially free of formula (5), (6), (7) or (8).

In certain embodiments, the number-average molecular weight ($M_n$), of the polymer disclosed herein is greater than about 500 Mn, greater than 2,000 Mn, greater than 5,000 Mn, greater than 10,000 Mn, greater than 25,000 Mn or up to 50,000 Mn. In other embodiments the number-average molecular weight (Mn) is less than 50,000 Mn, less than 25,000 Mn, less than 10,000 Mn, less than 5,000 Mn, less than 2,000 Mn, or a low as 500 Mn.

In some embodiments, the polymer is an interpolymer. In further embodiments, the polymer disclosed herein comprises one or more units derived from branched olefin having at least one monomer equivalent to lower olefins having 5 to 10 carbon atoms in an amount of at least about 5 mole percent, at least about 10 mole percent, at least about 15 mole percent, at least about 20 mole percent, at least about 30 mole percent, at least about 40 mole percent, at least about 50 mole percent, at least about 60 mole percent, at least about 70 mole percent, at least about 80 mole percent, or at least about 90 mole percent of the whole polymer. In still further embodiments, the polymer disclosed herein comprises one or more units derived from the vinyl monomer in an amount of at least about 5 mole percent, at least about 10 mole percent, at least about 15 mole percent, at least about 20 mole percent, at least about 30 mole percent, at least about 40 mole percent, at least about 50 mole percent, at least about 60 mole percent, at least about 70 mole percent, at least about 80 mole percent, or at least about 90 mole percent of the whole polymer.

Any compound containing a vinyl group, i.e., $—CH{=}CH_2$, that is co-polymerizable with a branched olefin as a vinyl monomer for making the polymer disclosed herein. Useful vinyl monomers disclosed herein include ethylene, i.e., $CH_2{=}CH_2$. In certain embodiments, the vinyl monomer has formula (14):

14

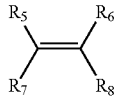

where each of $R_5$, $R_6$, $R_7$ and $R_8$ is independently H, or an organyl group. In further embodiments, the organyl group is hydrocarbyl. In certain embodiments, each of $R_5$, $R_6$, $R_7$ and $R_8$ of formula (13) or (14) is independently H, alkyl, cycloalkyl, aryl, alkenyl, cycloalkenyl, or alkynyl. In certain embodiments, $R_5$ of formula (13) or (14) is aryl; and each of $R_6$, $R_7$ and $R_8$ is H. In further embodiments, $R_5$ of formula (13) or (14) is phenyl; and each of $R_6$, $R_7$ and $R_8$ is H.

In certain embodiments, at least one of $R_5$, $R_6$, $R_7$ and $R_8$ of formula (13) or (14) is H. In other embodiments, each of $R_5$, $R_6$, $R_7$ and $R_8$ of formula (13) or (14) is H. In further embodiments, $R_5$ of formula (13) or (14) is hydrocarbyl; and each of $R_6$, $R_7$ and $R_8$ is H. In still further embodiments, the hydrocarbyl is alkyl, cycloalkyl or aryl. In still further embodiments, none of $R_5$, $R_6$, $R_7$ and $R_8$ of formula (13) or (14) is or comprises alkenyl, cycloalkenyl or alkynyl.

In some embodiments, the vinyl monomer is a substituted or unsubstituted olefin such as ethylene or styrene. In other embodiments, the vinyl monomer is ethylene, an α-olefin or a combination thereof. Some non-limiting examples of suitable α-olefins include styrene, propylene, 1-butene, 1-hexene, 1-octene, 4-methyl-1-pentene, norbornene, 1-decene, 1,5-hexadiene and combinations thereof.

In some embodiments, the vinyl monomer is an aryl such as styrene, α-methyl styrene, or di-vinyl benzene. Additional examples include the functionalized vinyl aryls such as those disclosed by U.S. Pat. No. 7,041,761 which is incorporated herein by reference in its entirety.

In some embodiments, the polymer disclosed herein are derived from at least one farnesene and at least one vinyl monomer as described by formula (14). Depending on the selection of catalysts, any olefin may be used in embodiments described herein. Some non-limiting examples of suitable olefins include $C_{2-20}$ aliphatic and $C_{8-20}$ aromatic compounds containing vinylic unsaturation, as well as cyclic compounds, such as cyclobutene, cyclopentene, dicyclopentadiene, and norbornene, including but not limited to, norbornene substituted in the 5 and 6 position with $C_{1-20}$ hydrocarbyl or cyclohydrocarbyl groups. Other non-limiting examples of suitable olefins include mixtures of such olefins as well as mixtures of such olefins with $C_{4-40}$ diolefin compounds.

Some non-limiting examples of suitable vinyl monomers include styrene, ethylene, propylene, isobutylene, 1-butene, 1-pentene, 1-hexene, 1-heptene, 1-octene, 1-nonene, 1-decene, and 1-dodecene, 1-tetradecene, 1-hexadecene, 1-octadecene, 1-eicosene, 3-methyl-1-butene, 3-methyl-1-pentene, 4-methyl-1-pentene, 4,6-dimethyl-1-heptene, 4-vinylcyclohexene, vinylcyclohexane, norbornadiene, ethylidene norbornene, cyclopentene, cyclohexene, dicyclopentadiene, cyclooctene, $C_{4-40}$ dienes, including but not limited to 1,3-butadiene, 1,3-pentadiene, 1,4-hexadiene, 1,5-hexadiene, 1,7-octadiene, 1,9-decadiene, other $C_{4-40}$ α-olefins, and the like. In certain embodiments, the olefin monomer is propylene, 1-butene, 1-pentene, 1-hexene, 1-octene or a combination thereof.

Any catalyst that can polymerize or copolymerize farnesene can be used for making the polymer disclosed herein. Some non-limiting examples of suitable catalysts include organolithium reagents, Ziegler-Natta catalysts, Kaminsky catalysts and other metallocene catalysts. In some embodiments, the catalyst is a Ziegler-Natta catalyst, a Kaminsky catalyst, a metallocene catalyst or a combination thereof.

In some embodiments, the catalyst further comprises a cocatalyst. In further embodiments, the cocatalyst is a hydride, alkyl or aryl of a metal or a combination thereof. In still further embodiments, the metal is aluminum, lithium, zinc, tin, cadmium, beryllium or magnesium.

In some embodiments, the catalyst is an organolithium reagent. Any organolithium reagent that can act as a catalyst to polymerize olefins can be used herein. Some non-limiting examples of suitable organolithium reagents include n-butyllithium, sec-butyllithium or tert-butyllithium. Some non-limiting examples of suitable Lewis bases include TMEDA, PMDTA or sparteine. Some organolithium reagents are disclosed in Zvi Rappoport et al., "*The Chemistry of Organolithium Compounds*," Part 1 (2004) and Vol. 2 (2006), both of which are incorporated herein by reference.

In some embodiments, the catalyst is a mixture of an organolithium reagent and a Lewis base. Any Lewis base that can deaggregate organolithium reagents, making them more soluble and more reactive, can be used herein. An aggregated organolithium reagent generally has one lithium coordinating to more than one carbon atom and one carbon coordinating to more than one lithium atom. Some non-limiting examples of suitable Lewis bases include 1,2-bis (dimethylamino)ethane (also known as tetramethylethylenediamine or TMEDA), N,N,N',N',N"-pentamethyldiethylenetriamine (PMDTA), sparteine and combinations thereof.

In some embodiments, the catalyst is a Ziegler-Natta catalyst. Generally, Ziegler-Natta catalysts can be heterogeneous or homogeneous. In some embodiments, the Ziegler-Natta catalyst used for polymerizing the polyfarnesenes disclosed herein is a heterogeneous Ziegler-Natta catalyst. Some useful Ziegler-Natta catalysts are disclosed in J. Boor, "Ziegler-Natta Catalysts and Polymerizations," Saunders College Publishing, pp. 1-687 (1979); and Malcolm P. Stevens, "*Polymer Chemistry, an Introduction*," Third Edition, Oxford University Press, pp. 236-245 (1999), both of which are incorporated herein by reference.

In certain embodiments, the Ziegler-Natta catalyst can be impregnated on a support material. Some suitable support materials are disclosed in Malcolm P. Stevens, "*Polymer Chemistry, an Introduction*," Third Edition, Oxford University Press, p. 251 (1999), which is incorporated herein by reference.

In certain embodiments, the catalyst used herein is or comprises a Kaminsky catalyst, also known as homogeneous Ziegler-Natta catalyst. The Kaminsky catalyst can be used to produce olefin copolymers. Some Kaminsky catalysts or homogeneous Ziegler-Natta catalysts are disclosed in Malcolm P. Stevens, "*Polymer Chemistry, an Introduction*," Third Edition, Oxford University Press, pp. 245-251 (1999); and John Scheirs and Walter Kaminsky, "*Metallocene-Based Polyolefins: Preparation, Properties, and Technology*," Volume 1, Wiley (2000), both of which are incorporated herein by reference.

In certain embodiments, the catalyst for making the olefin copolymer disclosed herein is or comprises a metallocene catalyst. Some metallocene catalysts are disclosed in Tae Oan Ahn et al., "*Modification of a Ziegler-Natta catalyst with a metallocene catalyst and its olefin polymerization behavior*," Polymer Engineering and Science, 39(7), p. 1257 (1999); and John Scheirs and Walter Kaminsky, "*Metallo-*

*cene-Based Polyolefins: Preparation, Properties, and Technology*," Volume 1, Wiley (2000), both of which are incorporated herein by reference.

Examples of polymer useful in compositions disclosed herein are taught in U.S. Pat. Nos. 7,655,739; 7,759,444; 7,868,114; 7,868,115; 8,217,128; 8,334,353; 8,048,976; 8,592,543; 8,592,543, 8,889,808; 9,862,906; 10,294,439.

In some embodiments, the polymer disclosed herein can be hydrogenated partially or completely by any hydrogenating agent known to a skilled artisan. For example, a saturated or partially saturated polymer can be prepared by (a) polymerizing a branched polyolefin disclosed herein in the presence of a catalyst disclosed herein to form an polymer; and (b) hydrogenating at least a portion or all of the double bonds in the polymer in the presence of a hydrogenation reagent. In some embodiments, the branched olefin is copolymerized with a vinyl monomer disclosed herein to form a polymer and is then partially or fully hydrogenated.

In certain embodiments, the hydrogenation reagent is hydrogen in the presence of a hydrogenation catalyst. In some embodiments, the hydrogenation catalyst is Pd, Pd/C, Pt, $PtO_2$, $Ru(PPh_3)_2Cl_2$, Raney nickel or a combination thereof. In one embodiment, the catalyst is a Pd catalyst. In another embodiment, the catalyst is 5% Pd/C. In a further embodiment, the catalyst is 10% Pd/C in a high-pressure reaction vessel and the hydrogenation reaction is allowed to proceed until completion. Generally, after completion, the reaction mixture can be washed, concentrated, and dried to yield the corresponding hydrogenated product. Alternatively, any reducing agent that can reduce a C═C bond to a C—C bond can also be used. For example, the olefin copolymer can be hydrogenated by treatment with hydrazine in the presence of a catalyst, such as 5-ethyl-3-methyllumiflavinium perchlorate, under an oxygen atmosphere to give the corresponding hydrogenated products. The reduction reaction with hydrazine is disclosed in Imada et al., *J. Am. Chem. Soc.,* 127, 14544-14545 (2005), which is incorporated herein by reference.

In some embodiments, the carboxylic acid functionality or a reactive equivalent thereof is grafted onto the polymer to form an acylated polymer. An ethylenically unsaturated carboxylic acid material is typically grafted onto the polymer backbone. These materials which are attached to the polymer typically contain at least one ethylenic bond (prior to reaction) and at least one, such as two, carboxylic acid (or its anhydride) groups or a polar group which is convertible into said carboxyl groups by oxidation or hydrolysis. Maleic anhydride or a derivative thereof is suitable. It grafts onto the polymer, to give two carboxylic acid functionalities. Examples of additional unsaturated carboxylic materials include itaconic anhydride, or the corresponding dicarboxylic acids, such as maleic acid, fumaric acid and their esters, as well as cinnamic acid and esters thereof.

The ethylenically unsaturated carboxylic acid material may be grafted onto the polymer in a number of ways. It may be grafted onto the polymer in solution or in molten form with or without using a radical initiator. The free-radical induced grafting of ethylenically unsaturated carboxylic acid materials may also be conducted in solvents, such as hexane or mineral oil. It may be carried out at an elevated temperature in the range of 100° C. to 250° C., e.g., 120° C. to 190° C., or 150° C. to 180° C., e.g., above 160° C.

The free-radical initiators which may be used include peroxides, hydroperoxides, and azo compounds, typically those which have a boiling point greater than about 100° C. and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator may be used in an amount of 0.005% to 1% by weight based on the weight of the reaction mixture solution. The grafting may be carried out in an inert atmosphere, such as under nitrogen blanketing. The resulting acylated polymer intermediate is characterized by having carboxylic acid acylating functions within its structure.

In some embodiments, the acylated polymer is reacted with an alcohol or an amine to from an amide, imide, ester or combinations thereof. The reaction may consist of condensation to form an imide, an amide, a half-amide or amide-ester or an amine salt. A primary amino group will typically condense to form an amide or, in the case of maleic anhydride, an imide. It is noted that in certain embodiments the amine will have a single primary amino group.

Suitable amines may include aromatic amines, such as amines wherein a carbon atom of the aromatic ring structure is attached directly to the amino nitrogen. The amine may also aliphatic. In certain embodiments aliphatic amines can be used alone or in combination with each other or in combination with aromatic amines. The amount of aromatic amine may, in some embodiments, be a minor amount compared with the amount of the non-aromatic amines, or in some instance, the composition may be substantially free or free of aromatic amine.

Examples of aromatic amines which may be used in the instant compositions to synthesize suitable polyether aromatic amines include an N-arylphenylenediamine represented by the formula:

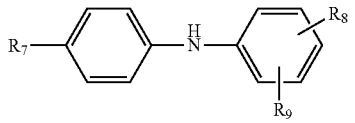

wherein $R_7$ is H. —NHaryl, —NHalkaryl. or a branched or straight chain hydrocarbyl radical having from about 4 to about 24 carbon atoms selected from alkyl, alkenyl, alkoxyl, aralkyl or alkaryl; $R_9$ is —$NH_2$. —$(NH(CH_2)_n)_m$ $NH_2$, —NHalkyl, —NHaralkyl, —CH2-aryl-NH2, in which n and m each have a value from about 1 to about 10; and $R_8$ is hydrogen, alkyl, alkenyl, alkoxyl, aralkyl, or alkaryl, having from about 4 to about 24 carbon atoms.

Suitable N-arylphenylenediamines include N-phenylphenylenediamines (NPPDA), for example, N-phenyl-1,4-phenylenediamine, N-phenyl-1,3-phe-nylenediamine, and N-phenyl-1,2-phenylenediamine and N-naphthyl-1,4-phenylenediamine. Other derivatives of NPPDA may also be included, such as N-propyl-N'-phenylphenylenediamine.

In a particular embodiment, the amine reacted with the acylated polymer is an amine having at least 3 or 4 aromatic groups and may be represented by the following formula

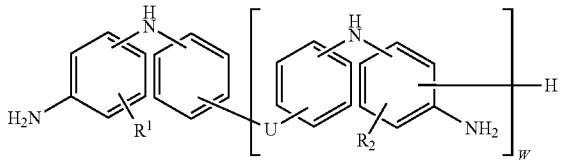

wherein independently each variable, R1 may be hydrogen or a C1 to C5 alkyl group (typically hydrogen); R2 may be hydrogen or a C1 to C5 alkyl group (typically hydrogen); U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

Other Examples of aromatic amines include aniline, N-alkylanilines such as N-methyl aniline, and N-butylaniline, di-(para-methylphenyl)amine, naphthylamine, 4-aminodiphenylamine, N,N-dimethylphenylenediamine, 4-(4-nitrophenylazo)aniline (disperse orange 3), sulfamethazine, 4-phenoxyaniline, 3-nitroaniline, 4-aminoacetanilide, 4-amino-2-hydroxy-benzoic acid phenyl ester (phenyl amino salicylate), N-(4-amino-5-methoxy-2-methyl-phenyl)-benzamide (fast violet B), N-(4-amino-2,5-dimethoxy-phenyl)-benzamide (fast blue RR), N-(4-amino-2,5-diethoxy-phenyl)-benzamide (fast blue BB), N-(4-amino-phenyl)-benzamide and 4-phenylazoaniline. Suitable amines are referenced in U.S. Pat. No. 7,790,661 and are hereby incorporated by reference.

In one embodiment, the compound having an oxygen atom capable of condensing with the acylated polymer can be represented by the following formulas:

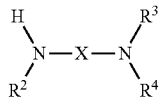

wherein X is a alkylene group containing about 1 to about 4 carbon atoms; R2, R3 and R4 are hydrocarbyl groups.

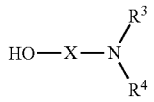

wherein X is an alkylene group containing about 1 to about 4 carbon atoms; R3 and R4 are hydrocarbyl groups Examples of the nitrogen or oxygen contain compounds capable of condensing with the acylating agent and further having a tertiary amino group can include but are not limited to: dimethylaminopropylamine, N,N-dimethyl-aminopropylamine, N,N-diethyl-aminopropylamine, N,N-dimethyl-ami-noethylamine ethylenediamine, 1,2-propylenediamine, 1,3-propylene diamine, the isomeric butylenediamines, pentanediamines, hexanediamines, heptanediamines, diethylenetriamine, dipropylenetriamine, dibutylenetriamine, triethylenetetraamine, tetraethylenep entaamine, pentaethylenehexaamine, hexamethylenetetramine, and bis (hexamethylene) triamine, the diaminobenzenes, the diaminopyridines or mixtures thereof. The nitrogen or oxygen containing compounds capable of condensing with the acylating agent and further having a tertiary amino group can further include aminoalkyl substituted heterocyclic compounds such as 1-(3-aminopropyl)imidazole and 4-(3-amino-propyl)morpholine, 1-(2-amino ethyl)piperidine, 3,3-di-amino-N-methyldipropylamine, 3',3-aminobis(N,N-dimethylpropyl amine). Another type of nitrogen or oxygen containing compounds capable of condensing with the acylating agent and having a tertiary amino group include alkanolamines including but not limited to triethanolamine, trimethanolamine, N,N-dimethylaminopropanol, N,N-diethylaminopropanol, N,N-diethylaminobutanol, N,N,N-tris (hydroxyethyl)amine, N,N,N-tris(hydroxymethyl)amine.

In certain embodiments, non-aromatic amines can be used alone or in combination with each other or in combination with aromatic amines. The amount of aromatic amine may, in some embodiments, be a minor amount compared with the amount of the non-aromatic amines, or in some instance, the composition may be substantially free or free of aromatic amine.

In one embodiment, the polymer is reacted with a polyether aromatic compound. Typically, the polyether aromatic compound will have at least two functional groups, each capable of reacting with a monocarboxylic acid or ester thereof, or dicarboxylic acid, anhydride or ester thereof, or mixtures thereof. Suitable polyether aromatic compounds include, but are not limited to, the following: Polyether Aromatic Compounds Derived from an Aromatic Aminic Compound In one embodiment, the polyether aromatic compound is derived from an aromatic compound containing at least one amine group and wherein the poly ether is capable of reacting with a monocarboxylic acid or ester thereof, or dicarboxylic acid, anhydride or ester thereof.

Examples of suitable polyether aromatic amines include compounds having the following structure:

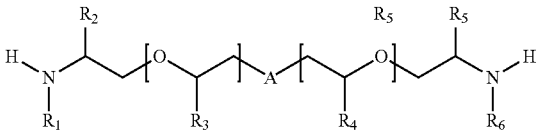

in which A represents an aromatic aminic moiety wherein the ether groups are linked through at least one amine group on the aromatic moiety; $R_1$ and $R_6$ are independently hydrogen, alkyl, alkaryl, aralkyl, or aryl or mixtures; thereof, $R_2$, $R_3$, $R_4$, and $R_5$ are independently hydrogen or alkyl containing from about 1 to about 6 carbon atoms of mixtures thereof, and a and x are independently integers from about 1 to about 50.

The acylated polymer may be reacted with a polyether amine or polyether polyamine. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Hunstman Corporation.

Another aspect of the present disclosure includes a process for formulating a lubricant, the process comprising combining an oil of lubricating viscosity with an additive mixture, wherein (a) the additive mixture comprises a polymeric surfactant compound that is an acylated polymer comprising a polymer having a number average molecular weight of about 300 Da to about 50,000 Da, or about 2000 Da to about 50,000 Da, or preferred about 2000 Da to about 25,000 Da and comprises a branched olefin having from 8 to 30 carbon atoms (b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof.

Another aspect of the present disclosure is a process for formulating a lubricant, the process comprising combining an oil of lubricating viscosity with an additive mixture, wherein (a) the additive mixture comprises polymeric surfactant compound that is an acylated polymer comprising a polymer having a number average molecular weight of about 500 Da to about 50,000 Da, and comprises a branched olefin having from 8 to 30 carbon atoms, and wherein the acylated polymer is further reacted with an amine or alcohol to form an amide, imide, ester or combinations thereof.

(b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof.

Another aspect of the present disclosure is a process for formulating a lubricant, the process comprising combining an oil of lubricating viscosity with an additive mixture, wherein the lubricating composition has a High Temperature High Shear (HTHS) as measured by ASTM D4683 of less than 3.5 cP or less than 3 cP or less than 2.5 cP.

A further aspect of the technology relates to methods of lubricating a mechanical device, for example, by supplying to the device the lubricating composition described herein containing the grafted copolymer viscosity modifier. The mechanical device can be, for example, an internal combustion engine, an automotive driveline device, such as a transmission or an axle, or an off-highway vehicle. The technology could also be employed in industrial applications, such as industrial hydraulics.

Another aspect of the present disclosure is an internal combustion engine lubricated by an engine oil, the improvement comprising an engine oil according to any of the preceding paragraphs.

The lubricating compositions described above may be utilized in an internal combustion engine. The engine components may have a surface of steel or aluminum (typically a surface of steel) and may also be coated for example with a diamondlike carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may be fitted with an emission control system or a turbocharger. Examples of the emission control system include diesel particulate filters (DPF), or systems employing selective catalytic reduction (SCR).

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment, the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment, the sulfated ash content may be 0.05 wt % to 0.9 wt %, or 0.1 wt % to 0.2 wt % or to 0.45 wt %.

In one embodiment, the lubricating composition may be an engine oil, wherein the lubricating composition may be characterized as having at least one of (i) a sulfur content of 0.5 wt % or less, (ii) a phosphorus content of 0.1 wt % or less, (iii) a sulfated ash content of 1.5 wt % or less, or combinations thereof.

Another aspect of the present disclosure is a process for formulating an engine oil, the process comprising combining an oil of lubricating viscosity with an additive mixture, wherein the additive mixture comprises a polymeric surfactant compound that is an acylated polymer comprising a polymer having a number average molecular weight of about 300 Da to about 50,000 Da, or about 2000 Da to about 50,000 Da, or preferred about 2000 Da to about 25,000 Da and comprises a branched olefin having from 8 to 30 carbon atoms and One or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the additive mixture without variation of the combination of additives or the relative proportions thereof within the additive mixture that meets or exceeds the performance requirements of one or more of the following engine oil certification programs: ILSAC GF-5, ILSAC GF-6, API SN, dexos, CJ-4, ACEA-A1, ACEA-A2, ACE A-A3, ACEA-B1, ACEA-B2, ACEA-B3, ACEA-B4, ACEA-E1, ACEA-E2, ACEA-E3, ACEA-E4, and PC-11.

Another aspect of the present disclosure is a process for formulating an engine oil, the process comprising combining an oil of lubricating viscosity with an additive mixture, wherein (a) the additive mixture comprises polymeric surfactant compound that is an acylated polymer comprising a polymer having a number average molecular weight of about 500 Da to about 50,000 Da, and comprises a branched olefin having from 8 to 30 carbon atoms, and wherein the acylated polymer is further reacted with an amine or alcohol to form an amide, imide, ester or combinations thereof.

(b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the additive mixture without variation of the combination of additives or the relative proportions thereof within the additive mixture that meets or exceeds the performance requirements of one or more of the following engine oil certification programs: ILSAC GF-5, TLSAC GF-6, API SN, dexos, CJ-4, ACEA-A1, ACEA-A2, ACE A-A3, ACEA-B1, ACEA-B2, ACEA-B3, ACEA-B4, ACEA-E1, ACEA-E2, ACEA-E3, ACEA-E4, and PC-11.

In one method embodiment, the method may comprise lubricating a manual transmission by supplying the lubricant composition as described above to the manual transmission. The manual transmission may have synchromesh, or in another embodiment the manual transmission does not have a synchromesh. The synchromesh may be composed of aluminum, steel, bronze, molybdenum, brass (sintered or non-sintered), carbon in the form of fibers, graphitic material (optionally in combination with a cellulosic material), or a cellulosic material, or a phenolic resin.

In another method embodiment, the method may comprise lubricating a gear, gearbox or axle gear by supplying a lubricant composition as described above to the gear, gearbox or axle.

In another embodiment, the method may comprise lubricating an automatic transmission by supplying a lubricant composition as described above to the automatic transmission. The automatic transmission includes continuously variable transmissions (CVT), infinitely variable transmissions (IVT), Toroidal transmissions, continuously slipping torque converted clutches (CSTCC), stepped automatic transmissions or dual clutch transmissions (DCT).

In yet another method embodiment, the method may comprise lubricating a farm tractor transmission by supplying a lubricant composition as described above. The farm tractor transmission lubricated typically has a wet-brake, a transmission, a hydraulic, a final drive, a power take-off system. These parts are typically lubricated by a single lubricant supplied from a common sump. The transmission may be a manual transmission or an automatic transmission.

Another aspect of the present disclosure is a process for formulating a gear oil, the process comprising combining an oil of lubricating viscosity with an additive mixture, wherein (a) the additive mixture comprises a polymeric surfactant compound that is an acylated polymer comprising a polymer having a number average molecular weight of about 300 Da to about 50,000 Da, or about 2000 Da to about 50,000 Da, or preferred about 2000 Da to about 25,000 Da and comprises a branched olefin having from 8 to 30 carbon atoms (b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the additive mixture without variation of the combination of additives or the relative proportions thereof within the additive mixture that meets or exceeds the performance requirements of one or more of the following API Gear oil categories: API GL-4, GL-5, MIL-L-2105D, MIL-PRF-2105E, MT-1, and SAE Standard J2360.

Another aspect of the present disclosure is a process for formulating a gear oil, the process comprising combining an oil of lubricating viscosity with an additive mixture, wherein (a) the additive mixture comprises polymeric surfactant compound that is an acylated polymer comprising a polymer having a number average molecular weight of about 500 Da to about 50,000 Da, and comprises a branched olefin having from 8 to 30 carbon atoms, and wherein the acylated polymer is further reacted with an amine or alcohol to form an amide, imide, ester or combinations thereof.

(b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the additive mixture without variation of the combination of additives or the relative proportions thereof within the additive mixture that meets or exceeds the performance requirements of one or more of the following Gear oil categories: API GL-4, GL-5, MIL-L-2105D, MIL-PRF-2105E, MT-1, and SAE Standard J2360.

Another aspect of the present disclosure is a process for formulating an automatic transmission fluid, the process comprising combining an oil of lubricating viscosity with an additive mixture, wherein (a) the additive mixture comprises a polymeric surfactant compound that is an acylated polymer comprising a polymer having a number average molecular weight of about 300 Da to about 50,000 Da, or about 2000 Da to about 50,000 Da, or preferred about 2000 Da to about 25,000 Da and comprises a branched olefin having from 8 to 30 carbon atoms (b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the additive mixture without variation of the combination of additives or the relative proportions thereof within the additive mixture that meets or exceeds the performance requirements of one or more of the following performance categories: DEXRON ULV, MERCON ULV, Mopar ATF+4, DEXRON III/MERCON, DEXRON VI/MERCON V, MERCON V—Most Ford, Mercury, Lincoln, Mazda B-Series, 2001-08 Mazda Tribute, MERCON LV, MERCON SP, Toyota ATF Type T-IV (T4), and Toyota ATF WS.

Another aspect of the present disclosure is a process for formulating an automatic transmission fluid, the process comprising combining an oil of lubricating viscosity with an additive mixture, wherein (a) the additive mixture comprises polymeric surfactant compound that is an acylated polymer comprising a polymer having a number average molecular weight of about 500 Da to about 50,000 Da, and comprises a branched olefin having from 8 to 30 carbon atoms, and wherein the acylated polymer is further reacted with an amine or alcohol to form an amide, imide, ester or combinations thereof.

(b) one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the additive mixture without variation of the combination of additives or the relative proportions thereof within the additive mixture that meets or exceeds the performance requirements of one or more of the following performance categories: DEXRON ULV, MERCON ULV, Mopar ATF+4, DEXRON III/MERCON, DEXRON VI/MERCON V, MERCON V—Most Ford, Mercury, Lincoln, Mazda B-Series, 2001-08 Mazda Tribute, MERCON LV, MERCON SP, Toyota ATF Type T-IV (T4), and Toyota ATF WS.

Formulation Additives:

Dispersant

A composition disclosed herein may further include an ashless dispersant. The dispersant may be a succinimide dispersant, a Mannich dispersant, a polyolefin succinic acid ester, amide, or ester-amide, or mixtures thereof. In one embodiment, the dispersant may be a borated succinimide dispersant. In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment, the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Hunstman Corporation.

The dispersant may be a N-substituted long chain alkenyl succinimide. Examples of N-substituted long chain alkenyl succinimide include polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent 0 355 895B1.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be borated using one or more of a variety of agents selected from the group consisting of the various forms of boric acid (including metaboric acid, $HBO_2$, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents. Methods of preparing borated dispersants are known in the art. The borated dispersant may be prepared in such a way that they contain 0.1 weight % to 2.5 weight % boron, or 0.1 weight % to 2.0 weight % boron or 0.2 to 1.5 weight % boron or 0.3 to 1.0 weight % boron.

Suitable polyisobutylenes for use in the succinimide dispersant may include those formed from polyisobutylene or highly reactive polyisobutylene having at least about 50 mol %, such as about 60 mol %, and particularly from about 70 mol % to about 90 mol % or greater than 90 mol %, terminal vinylidene content. Suitable polyisobutenes may include those prepared using $BF_3$ catalysts. In one embodiment, the borated dispersant is derived from a polyolefin having number average molecular weight of 350 to 3000 Daltons and a vinylidene content of at least 50 mol %, or at least 70 mol %, or at least 90 mol %.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may be used alone or as part of a mixture of non-borated and borated dispersants. If a mixture of dispersants is used, there may be two to five, or two to three or two dispersants.

The polyolefin dispersant may comprise a polyalphaolefins (PAO) containing dispersant selected from the group consisting of a polyalphaolefin succinimide, a polyalphaolefin succinamide, a polyalphaolefin acid ester, a polyalphaolefin oxazoline, a polyalphaolefin imidazoline, a polyalphaolefin succinamide imidazoline, and combinations thereof.

Polyalphaolefins (PAO) useful as feedstock in forming the PAO containing dispersants are those derived from oligomerization or polymerization of ethylene, propylene, and α-olefins. Suitable α-olefins include 1-butene, 1-pentene, 1-hexene, 1-heptene, 1-octene, 1-nonene, 1-decene, 1-undecene, 1-dodecene, 1-tetradecene, and 1-octadecene. Feedstocks containing a mixture of two or more of the foregoing monomers as well as other hydrocarbons are typically employed when manufacturing PAOs commercially. The PAO may take the form of dimers, trimers, tetramers, polymers, and the like.

The PAO may be reacted with maleic anhydride (MA) to form the polyalphaolefin succinic anhydride (PAO-SA) and subsequently the anhydride may be reacted with one or more of polyamines, aminoalcohols, and alcohols/polyols to form polyalphaolefin succinimide, polyalphaolefin succinamide, polyalphaolefin succinic acid ester, polyalphaolefin oxazoline, polyalphaolefin imidazoline, polyalphaolefin-succinamide-imidazoline, and mixtures thereof.

Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515.

A useful nitrogen containing dispersant includes the product of a Mannich reaction between (a) an aldehyde, (b) a polyamine, and (c) an optionally substituted phenol. The phenol may be substituted such that the Mannich product has a molecular weight of less than 7500. Optionally, the molecular weight may be less than 2000, less than 1500, less than 1300, or for example, less than 1200, less than 1 100, less than 1000. In some embodiments, the Mannich product has a molecular weight of less than 900, less than 850, or less than 800, less than 500, or less than 400. The substituted phenol may be substituted with up to 4 groups on the aromatic ring. For example, it may be a tri or di-substituted phenol. In some embodiments, the phenol may be a mono-substituted phenol. The substitution may be at the ortho, and/or meta, and/or para position(s). To form the Mannich product, the molar ratio of the aldehyde to amine is from 4:1 to 1:1 or, from 2:1 to 1:1. The molar ratio of the aldehyde to phenol may be at least 0.75:1; preferably from 0.75 to 1 to 4:1, preferably 1:1 to 4; 1 more preferably from 1:1 to 2:1. To form the preferred Mannich product, the molar ratio of the phenol to amine is preferably at least 1.5:1, more preferably at least 1.6:1, more preferably at least 1.7:1, for example at least 1.8:1, preferably at least 1.9:1. The molar ratio of phenol to amine may be up to 5:1; for example it may be up to 4:1, or up to 3.5:1. Suitably it is up to 3.25:1, up to 3:1, up to 2.5:1, up to 2.3:1 or up to 2.1:1.

In an embodiment, the fuel composition can comprise quaternary ammonium salts. The quaternary ammonium salts can comprise (a) a compound comprising (i) at least one tertiary amino group and (ii) a hydrocarbyl-substituent having a number average molecular weight of 100 to 5000, or 250 to 4000, or 100 to 4000 or 100 to 2500 or 3000; and (b) a quaternizing agent suitable for converting the tertiary amino group of (a)(i) to a quaternary nitrogen. These quaternary ammonium salts are more thoroughly described in U.S. Pat. No. 7,951,211, issued May 31, 2011, and U.S. Pat. No. 8,083,814, issued Dec. 27, 2011, and U. S. Publication Nos. 2013/01 18062, published May 16, 2013, 2012/00101 12, published Jan. 12, 2012, 2013/0133243, published May 30, 2013, 2008/01 13890, published May 15, 2008, and 201 1/0219674, published Sep. 15, 2011, US 2012/0149617 published May 14, 2012, US 2013/0225463 published Aug. 29, 2013, US 2011/0258917 published Oct. 27, 2011, US 201 1/0315107 published Dec. 29, 2011, US 2013/0074794 published Mar. 28, 2013, US 2012/0255512 published Oct. 11, 2012, US 2013/0333649 published Dec. 19, 2013, US 2013/01 18062 published May 16, 2013, and international publications WO Publication Nos. 201 1/141731, published Nov. 17, 2011, 201 1/095819, published Aug. 11, 2011, and 2013/017886, published Feb. 7, 2013, WO 2013/070503 published May 16, 2013, WO 201 1/1 10860 published Sep. 15, 2011, WO 2013/017889 published Feb. 7, 2013, WO 2013/017884 published Feb. 7, 2013.

In certain embodiments, the quaternizing agent used to prepare the additional quaternizing ammonium salts can be a dialkyl sulfate, an alkyl halide, a hydrocarbyl substituted carbonate, a hydrocarbyl epoxide, a carboxylate, alkyl esters, or mixtures thereof. In some cases, the quaternizing agent can be a hydrocarbyl epoxide. In some cases, the quaternizing agent can be a hydrocarbyl epoxide in combination with an acid. In some cases, the quaternizing agent can be a salicylate, oxalate or terephthalate. In an embodiment, the hydrocarbyl epoxide is an alcohol functionalized epoxide or $C_4$ to $C_{14}$ epoxides.

In some embodiments, the quaternizing agent is multifunctional resulting in the additional quaternary ammonium salts being a coupled quaternary ammoniums salt.

ENGINE OILS: When present, the additional other dispersant may be present in a composition, at 0.01 wt % to 12 wt % or 0.1 wt % to 8 wt % or 0.5 wt % to 6 wt % of the composition.

DRIVELINE: When present, the additional other dispersant may be present in a composition, at 0.1 wt % to 10 wt % or 0.1 wt % to 8 wt % or 1 wt % to 6 wt % or 0 wt % to 5 wt % of the composition.

Metal-Containing Detergent:

The compositions disclosed herein may further include a metal-containing detergent. Metal-containing detergents are well known in the art. They are generally made up of metal salts, especially alkali metals and alkaline earth metals, of acidic organic substrates. Metal-containing detergents may be neutral, i.e. a stoichiometric salt of the metal and substrate also referred to as neutral soap or soap, or overbased.

Metal overbased detergents, otherwise referred to as overbased detergents, metal-containing overbased detergents or superbased salts, are characterized by a metal content in excess of that which would be necessary for neutralization according to the stoichiometry of the metal and the particular acidic organic compound, i.e. the substrate, reacted with the metal. The overbased detergent may comprise one or more of non-sulfur containing phenates, sulfur containing phenates, sulfonates, salicylates, and mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased metal detergent may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g. phenate-salicylates, sulfonate-phenates, sulfonate-salicylates, sulfonates-phenates-salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively. Overbased phenates and salicylates typically have a total base number of 180 to 450 TBN. Overbased sulfonates typically have a total base number of 250 to 600, or 300 to 500. Overbased detergents are known in the art.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e. contains less than 0.1 weight percent) p-dodecylphenol. In one embodiment, the lubricating composition contains less than 0.3 weight percent of alkylphenol, less than 0.1 weight percent of alkylphenol, or less than 0.05 weight percent of alkylphenol.

The overbased metal-containing detergent may be alkali metal or alkaline earth metal salts. In one embodiment, the overbased detergent may be sodium salts, calcium salts, magnesium salts, or mixtures thereof of the phenates, sulfur-containing phenates, sulfonates, salixarates and salicylates. In one embodiment, the overbased detergent is a calcium detergent, a magnesium detergent or mixtures thereof. In one embodiment, the overbased calcium detergent may be present in an amount to deliver at least 500 ppm calcium by weight and no more than 3000 ppm calcium by weight, or at least 1000 ppm calcium by weight, or at least 2000 ppm calcium by weight, or no more than 2500 ppm calcium by weight to the lubricating composition. In one embodiment, the overbased detergent may be present in an amount to deliver no more than 500 ppm by weight of magnesium to the lubricating composition, or no more than 330 ppm by weight, or no more than 125 ppm by weight, or no more than 45 ppm by weight. In one embodiment, the lubricating composition is essentially free of (i.e. contains less than 10 ppm) magnesium resulting from the overbased detergent. In one embodiment, the overbased detergent may be present in an amount to deliver at least 200 ppm by weight of magnesium, or at least 450 ppm by weight magnesium, or at least 700 ppm by weight magnesium to the lubricating composition. In one embodiment, both calcium and magnesium containing detergents may be present in the lubricating composition. Calcium and magnesium detergents may be present such that the weight ratio of calcium to magnesium is 10:1 to 1:10, or 8:3 to 4:5, or 1:1 to 1:3. In one embodiment, the overbased detergent is free of or substantially free of sodium.

In one embodiment, the sulfonate detergent may be predominantly a linear alkylbenzene sulfonate detergent having a metal ratio of at least 8 as is described in paragraphs [0026] to [0037] of US Patent Publication 2005/065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent.

Salicylate detergents and overbased salicylate detergents may be prepared in at least two different manners. Carbonylation (also referred to as carboxylation) of a p-alkylphenol is described in many references including U.S. Pat. No. 8,399,388. Carbonylation may be followed by overbasing to form overbased salicylate detergent. Suitable p-alkylphenols include those with linear and/or branched hydrocarbyl groups of 1 to 60 carbon atoms. Salicylate detergents may also be prepared by alkylation of salicylic acid, followed by overbasing, as described in U.S. Pat. No. 7,009,072. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms. In one embodiment, the overbased detergent is a salicylate detergent. In one embodiment, the salicylate detergent is free of unreacted p-alkylphenol (i.e. contains less than 0.1 weight percent). In one embodiment, the salicylate detergent is prepared by alkylation of salicylic acid.

The metal-containing overbased detergents may be present at 0.2 wt % to 15 wt %, or 0.3 wt % to 10 wt %, or 0.3 wt % to 8 wt %, or 0.4 wt % to 3 wt % of a composition. For example, in a heavy-duty diesel engine, the detergent may be present at 2 wt % to 3 wt % of the lubricating composition. For a passenger car engine, the detergent may be present at 0.2 wt % to 1 wt % of the lubricating composition.

ENGINE OILS: When present, the metal-containing overbased detergents may be present in a composition, at 0.01 wt % to 9 wt % or 0.5 wt % to 8 wt % or 1 wt % to 5 wt % of the composition.

DRIVELINE: In an automotive gear oil, for example the detergent may be present in the lubrication composition in an amount of 0.05 wt % to 1 wt %, or 0.1 wt % to 0.9 wt %. In a manual transmission fluid, for example, the detergent may be present in the lubricating composition in an amount of at least 0.1 wt %, 0.14 wt % to 4 wt % or 0.2 wt % to 3.5 wt 0 or 0.5 wt % to 3 wt %, or 1 wt % to 2 wt %, or 0.5 wt % to 4 wt % or 0.6 wt % to 3.5 wt 0 or 1 wt % to 3 wt %, or at least 1 wt %. e.g., 1.5 wt % to 2.8 wt %

Metal-containing detergents contribute sulfated ash to a lubricating composition. Sulfated ash may be determined by ASTM D874. In one embodiment, the lubricating composition comprises a metal-containing detergent in an amount to deliver at least 0.4 weight percent sulfated ash to the total composition. In another embodiment, the metal-containing detergent is present in an amount to deliver at least 0.6 weight percent sulfated ash, or at least 0.75 weight percent sulfated ash, or even at least 0.9 weight percent sulfated ash to the lubricating composition. In one embodiment, the metal-containing overbased detergent is present in an amount to deliver 0.1 weight percent to 0.8 weight percent sulfated ash to the lubricating composition.

In addition to ash and TBN, overbased detergents contribute detergent soap, also referred to as neutral detergent salt, to the lubricating composition. Soap, being a metal salt of the substrate, may act as a surfactant in the lubricating composition. In one embodiment, the lubricating composition comprises 0.05 weight percent to 1.5 weight percent detergent soap, or 0.1 weight percent to 0.9 weight percent detergent soap. In one embodiment, the lubricating composition contains no more than 0.5 weight percent detergent soap. The overbased detergent may have a weight ratio of ash:soap of 5:1 to 1:2.3, or 3.5:1 to 1:2, or 2.9:1 to 1:1:7.

Polymeric Viscosity Modifier:

The compositions disclosed herein may further contain a polymeric viscosity modifier, a dispersant viscosity modifier, or combinations thereof. The dispersant viscosity modifier may be generally understood to be a functionalized, i.e. derivatized, form of a polymer similar to that of the polymeric viscosity modifier.

The polymeric viscosity modifier may be an olefin (co) polymer, a poly(meth)acrylate (PMA), or mixtures thereof. In one embodiment, the polymeric viscosity modifier is an olefin (co)polymer.

The olefin polymer may be derived from isobutylene or isoprene. In one embodiment, the olefin polymer is prepared from ethylene and a higher olefin within the range of C3-C10 alpha-mono-olefins, for example, the olefin polymer may be prepared from ethylene and propylene.

In one embodiment, the olefin polymer may be a polymer of 15 to 80 mole percent of ethylene, for example, 30 mol percent to 70 mol percent ethylene and from and from 20 to 85 mole percent of C3 to C10 mono-olefins, such as propylene, for example, 30 to 70 mol percent propylene or higher mono-olefins. Terpolymer variations of the olefin copolymer may also be used and may contain up to 15 mol percent of a non-conjugated diene or triene. Non-conjugated dienes or trienes may have 5 to about 14 carbon atoms. The non-conjugated diene or triene monomers may be characterized by the presence of a vinyl group in the structure and can include cyclic and bicycle compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In one embodiment, the olefin copolymer may be a copolymer of ethylene, propylene, and butylene. The polymer may be prepared by polymerizing a mixture of monomers comprising ethylene, propylene and butylene. These polymers may be referred to as copolymers or terpolymers. The terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. The butylene may comprise a mixture of butene-1 and isobutylene wherein the weight ratio of butene-1 to isobutylene is about 1:0.1 or less. The butylene may comprise butene-1 and be free of or essentially free of isobutylene.

In one embodiment, the olefin copolymer may be a copolymer of ethylene and butylene. The polymer may be prepared by polymerizing a mixture of monomers comprising ethylene and butylene wherein, the monomer composition is free of or substantially free of propylene monomers (i.e. contains less than 1 weight percent of intentionally added monomer). The copolymer may comprise 30 to 50 mol percent structural units derived from butylene; and from about 50 mol percent to 70 mol percent structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

Useful olefin polymers, in particular, ethylene-α-olefin copolymers have a number average molecular weight ranging from 4500 to 500,000, for example, 5000 to 100,000, or 7500 to 60,000, or 8000 to 45,000.

The formation of functionalized ethylene-α-olefin copolymer is well known in the art, for instance those described in U.S. Pat. No. 7,790,661 column 2, line 48 to column 10, line 38. Additional detailed descriptions of similar functionalized ethylene-α-olefin copolymers are found in International Publication WO2006/015130 or U.S. Pat. Nos. 4,863,623; 6,107,257; 6,107,258; 6,117,825; and 7,790,661. In one embodiment the functionalized ethylene-α-olefin copolymer may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment, the lubricating composition can comprise an additional dispersant viscosity modifier (DVM) other than the grafted copolymer viscosity modifier of the present disclosure. The DVM may comprise an olefin polymer that has been modified by the addition of a polar moiety.

The olefin polymers are functionalized by modifying the polymer by the addition of a polar moiety. In one useful embodiment, the functionalized copolymer is the reaction product of an olefin polymer grafted with an acylating agent. In one embodiment, the acylating agent may be an ethylenically unsaturated acylating agent. Useful acylating agents are typically α,β unsaturated compounds having at least one ethylenic bond (prior to reaction) and at least one, for example two, carboxylic acid (or its anhydride) groups or a polar group which is convertible into said carboxyl groups by oxidation or hydrolysis. The acylating agent grafts onto the olefin polymer to give two carboxylic acid functionalities. Examples of useful acylating agents include maleic anhydride, chlormaleic anhydride, itaconic anhydride, or the reactive equivalents thereof, for example, the corresponding dicarboxylic acids, such as maleic acid, fumaric acid, cinnamic acid, (meth)acrylic acid, the esters of these compounds and the acid chlorides of these compounds.

In one embodiment, the functionalized ethylene-α-olefin copolymer comprises an olefin copolymer grafted with the acyl group which is further functionalized with a hydrocarbyl amine, a hydrocarbyl alcohol group, amino- or hydroxy-terminated polyether compounds, and mixtures thereof.

Amine functional groups may be added to the olefin polymer by reacting the olefin copolymer (typically, an ethylene-α-olefin copolymer, such as an ethylene-propylene copolymer) with an acylating agent (typically maleic anhydride) and a hydrocarbyl amine having a primary or secondary amino group. In one embodiment, the hydrocarbyl amine may be selected from aromatic amines, aliphatic amines, and mixtures thereof.

In one embodiment, the hydrocarbyl amine component may comprise at least one aromatic amine containing at least one amino group capable of condensing with said acyl group to provide a pendant group and at least one additional group comprising at least one nitrogen, oxygen, or sulfur atom, wherein said aromatic amine is selected from the group consisting of (i) a nitro-substituted aniline, (ii) an amine comprising two aromatic moieties linked by a C(O)NR— group, a —C(O)O— group, an —O— group, an N═N— group, or an—SO2— group where R is hydrogen or hydrocarbyl, one of said aromatic moieties bearing said condensable amino group, (iii) an aminoquinoline, (iv) an aminobenzimidazole, (v) an N,N-dialkylphenylenediamine, (vi), an aminodiphenylamine (also N,N-phenyldiamine), and (vii) a ring-substituted benzylamine.

In one embodiment, the hydrocarbyl amine component may comprise at least one aliphatic amine containing at least one amino group capable of condensing with said acyl group to provide a pendant group and at least one additional group comprising at least one nitrogen, oxygen, or sulfur atom. Suitable aliphatic amines include polyethylene polyamines (such as tetraethylene pentamine (TEPA), triethylene tetra amine (TETA), pentaethylene hexamine (PEHA), and polyamine bottoms), N,N-dimethylaminopropylamine (DMAPA), N-(aminopropyl)morpholine, N,N-diIsostearylaminopropylamine, ethanolamine, and combinations thereof.

In another one embodiment, the polar moiety added to the functionalized ethylene-α-olefin copolymer may be derived from a hydrocarbyl alcohol group, containing at least one hydroxy group capable of condensing with said acyl group to provide a pendant group and at least one additional group comprising at least one nitrogen, oxygen, or sulfur atom. The alcohol functional groups may be added to the olefin polymer by reacting the olefin copolymer with an acylating agent (typically maleic anhydride) and a hydrocarbyl alcohol. The hydrocarbyl alcohol may be a polyol compound.

Suitable hydrocarbyl polyols include ethylene glycol and propylene glycol, trimethylol propane (TMP), pentaerythritol, and mixtures thereof.

In another one embodiment, the polar moiety added to the functionalized ethylene-α-olefin copolymer may be amine-terminated polyether compounds, hydroxy-terminated polyether compounds, and mixtures thereof. The hydroxy terminated or amine terminated polyether may be selected from the group comprising polyethylene glycols, polypropylene glycols, mixtures of one or more amine terminated polyether compounds containing units derived from ethylene oxides, propylene oxides, butylene oxides or some combination thereof, or some combination thereof. Suitable polyether compounds include Synalox® line of polyalkylene glycol compounds, the UCON™ OSP line of polyether compounds available from Dow Chemical, Jeffamine® line of polyether amines available from Huntsman.

In one embodiment, lubricating composition may comprise a poly(meth)acrylate polymeric viscosity modifier. As used herein, the term "(meth)acrylate" and its cognates means either methacrylate or acrylate, as will be readily understood.

In one embodiment, the poly(meth)acrylate polymer is prepared from a monomer mixture comprising (meth)acrylate monomers having alkyl groups of varying length. The (meth)acrylate monomers may contain alkyl groups that are straight chain or branched chain groups. The alkyl groups may contain 1 to 24 carbon atoms, for example 1 to 20 carbon atoms.

The poly(meth)acrylate polymers described herein are formed from monomers derived from saturated alcohols, such as methyl (meth)acrylate, ethyl (meth)acrylate, propyl (meth)acrylate, butyl (meth)acrylate, 2-methylpentyl (meth) acrylate, 2-propylheptyl (meth)acrylate, 2-butyloctyl (meth) acrylate, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyl-octadecyl-(meth)acrylate, octadecyl (meth)acrylate, nonadecyl (meth)acrylate, eicosyl (meth)acrylate, (meth)acrylates derived from unsaturated alcohols, such as oleyl (meth)acrylate; and cycloalkyl (meth)acrylates, such as 3-vinyl-2-butylcyclohexyl (meth) acrylate or bornyl (meth)acrylate.

Other examples of monomers include alkyl (meth)acrylates with long-chain alcohol-derived groups which may be obtained, for example, by reaction of a (meth)acrylic acid (by direct esterification) or methyl (meth)acrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

In one embodiment, the poly(meth)acrylate polymer comprises a dispersant monomer; dispersant monomers include those monomers which may copolymerize with (meth)acrylate monomers and contain one or more heteroatoms in addition to the carbonyl group of the (meth)acrylate. The dispersant monomer may contain a nitrogen-containing group, an oxygen-containing group, or mixtures thereof.

The oxygen-containing compound may include hydroxyalkyl(meth)acrylates such as 3-hydroxypropyl(meth)acrylate, 3,4-dihydroxybutyl(meth)acrylate, 2-hydroxyethyl (meth)acrylate, 2-hydroxypropyl(meth)acrylate, 2,5-dimethyl-1,6-hexanediol (meth)acrylate, 1,10-decanediol (meth)acrylate, carbonyl-containing (meth)acrylates such as 2-carboxyethyl(meth)acrylate, carboxymethyl(meth)acrylate, oxazolidinylethyl(meth)acrylate, N-(methacryloyloxy) formamide, acetonyl(meth)acrylate, N-methacryloylmorpholine, N-methacryloyl-2-pyrrolidinone, N-(2-methacryloyl-oxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxy-heptadecyl)-2-pyrrolidinone; glycol di(meth)acrylates such as 1,4-butanediol(meth)acrylate, 2-butoxyethyl(meth)acrylate, 2-ethoxyethoxymethyl(meth) acrylate, 2-ethoxyethyl(meth)acrylate, or mixtures thereof.

The nitrogen-containing compound may be a (meth) acrylamide or a nitrogen containing (meth)acrylate monomer. Examples of a suitable nitrogen-containing compound include N,N-dimethylacrylamide, N-vinyl carbonamides such as N-vinyl-formamide, vinyl pyridine, N-vinylacetoamide, N-vinyl propionamides, N-vinyl hydroxy-acetoamide, N-vinyl imidazole, N-vinyl pyrrolidinone, N-vinyl caprolactam, dimethylaminoethyl acrylate (DMAEA), dimethylaminoethyl methacrylate (DMAEMA), dimethylaminobutyl acrylamide, dimethylaminopropyl meth-acrylate (DMAPMA), dimethylaminopropyl acrylamide, dimethylaminopropyl methacrylamide, dimethylaminoethyl acrylamide or mixtures thereof.

Dispersant monomers may be present in an amount up to 5 mol percent of the monomer composition of the (meth) acrylate polymer. In one embodiment, the poly(meth)acrylate is present in an amount 0 to 5 mol percent, 0.5 to 4 mol percent, or 0.8 to 3 mol percent of the polymer composition. In one embodiment, the poly(meth)acrylate is free of or substantially free of dispersant monomers.

In one embodiment, the poly(meth)acrylate comprises a block copolymer or tapered block copolymer. Block copolymers are formed from a monomer mixture comprising one or more (meth)acrylate monomers, wherein, for example, a first (meth)acrylate monomer forms a discrete block of the polymer joined to a second discrete block of the polymer formed from a second (meth)acrylate monomer. While block copolymers have substantially discrete blocks formed from the monomers in the monomer mixture, a tapered block copolymer may be composed of, at one end, a relatively pure first monomer and, at the other end, a relatively pure second monomer. The middle of the tapered block copolymer is more of a gradient composition of the two monomers.

In one embodiment, the poly(meth)acrylate polymer (P) is a block or tapered block copolymer that comprises at least one polymer block ($B_1$) that is insoluble or substantially insoluble in the oil of lubricating viscosity and a second polymer block ($B_2$) that is soluble or substantially soluble in the oil of lubricating viscosity.

In one embodiment, the poly(meth)acrylate polymers may have an architecture selected from linear, branched, hyperbranched, cross-linked, star (also referred to as "radial"), or combinations thereof. Star or radial refers to multi-armed polymers. Such polymers include (meth)acrylate-containing polymers comprising 3 or more arms or branches, which, in some embodiments, contain at least about 20, or at least 50 or 100 or 200 or 350 or 500 or 1000 carbon atoms. The arms are generally attached to a multivalent organic moiety which acts as a "core" or "coupling agent." The multi-armed polymer may be referred to as a radial or star polymer, or even a "comb" polymer, or a polymer otherwise having multiple arms or branches as described herein.

Linear poly(meth)acrylates, random, block or otherwise, may have weight average molecular weight ($M_w$) of 1000 to 400,000 Daltons, 1000 to 150,000 Daltons, or 15,000 to 100,000 Daltons. In one embodiment, the poly(meth)acrylate may be a linear block copolymer with a Mw of 5,000 to 40,000 Daltons, or 10,000 to 30,000 Daltons.

Radial, cross-linked or star copolymers may be derived from linear random or di-block copolymers with molecular weights as described above. A star polymer may have a weight average molecular weight of 10,000 to 1,500,000 Daltons, or 40,000 to 1,000,000 Daltons, or 300,000 to 850,000 Daltons.

The polymeric viscosity modifiers and/or dispersant viscosity modifiers may be used in the functional fluids or lubricant compositions at a concentration of up to 20% or 60% or 70% by weight. Concentrations of 0.1 wt % to 12 wt % or 0.1 wt % to 4 wt %, or 0.2 wt % to 3 wt % or 1 wt % to 12 wt % or 3 wt % to 10 wt % may be used.

The lubricating compositions may comprise 0.05 wt % to 2 wt %, or 0.08 wt % to 1.8 wt %, or 0.1 wt % to 1.2 weight % of the one or more polymeric viscosity modifiers and/or dispersant viscosity modifiers as described herein.

ENGINE OILS: When present, the one or more polymeric viscosity modifiers and/or dispersant viscosity modifiers may be present in a composition, at 0.001 wt % to 10 wt % or 0 wt % to 5 wt %, or 0 wt % to 4 wt %, or 0.05 wt % to 2 wt %, or 0.2 wt % to 1.2 wt % of the lubricant composition.

DRIVELINE: When present, the one or more polymeric viscosity modifiers and/or dispersant viscosity modifiers may be present in a composition, at 0.1 wt % to 70 wt % or 1 wt % to 60 wt % or 0.1 wt % to 40 wt % or 0.1 wt % to 15 wt % or 15 wt % to 70 wt % of the composition.

Anti-Wear Agent:

Compositions prepared according to the instant disclosure may optionally include at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis (S-alkyldithiocarbamyl) disulfides. The antiwear agent may in one embodiment include a tartrate, or tartrimide as described in U.S. Pub. Nos. 2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as is disclosed in US Pub. No. 20050198894.

A composition may in one embodiment further include a phosphorus-containing antiwear agent. Example phosphorus-containing antiwear agents include zinc dialkyldithiophosphates, phosphites, phosphates, phosphonates, and ammonium phosphate salts, and mixtures thereof.

Compositions disclosed herein may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV) alkoxides, such as titanium (IV) isopropoxide and titanium (IV) 2 ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid monoesters of glycerol, where the fatty acid may be, for example, oleic acid. Other example oil soluble titanium compounds include titanium carboxylates, such as titanium neodecanoate.

When present in the composition, the amount of oil-soluble titanium compounds is included as part of the antiwear agent.

In another embodiment, the composition may have an antiwear additive comprising a phosphate amine salt. The C2-C18 (or C2 to C8 or C16-C18) di- or tri-hydrocarbyl phosphite, or mixtures thereof may be represented by the formula:

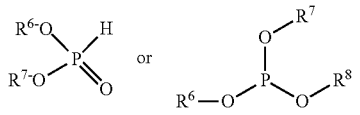

wherein at least one of R6, R7 and R8 may be a hydrocarbyl group containing at least 4 carbon atoms and the other may be hydrogen or a hydrocarbyl group. In one embodiment R6, R7 and R8 are all hydrocarbyl groups. The hydrocarbyl groups may be alkyl, cycloalkyl, aryl, acyclic or mixtures thereof. In the formula with all three groups R6, R7 and R8, the compound may be a tri-hydrocarbyl substituted phosphite i.e., R6, R7 and R8 are all hydrocarbyl groups and in some embodiments may be alkyl groups. Typically, the di- or tri-hydrocarbyl phosphite comprises dibutyl phosphite or oleyl phosphite.

The phosphorus-containing antiwear agent may include zinc dialkyldithiophosphate, a non-ionic phosphorus compound, which may be a hydrocarbyl phosphite; (i) a non-ionic phosphorus compound, which may be a hydrocarbyl phosphite; or (ii) an amine salt of a phosphorus compound, or mixtures thereof.

In one embodiment, the composition disclosed herein contains no zinc dialkyldithiophosphate. In one embodiment the lubricant composition disclosed herein contains zinc dialkyldithiophosphate. The phosphorus-containing compound may be a non-ionic phosphorus compound. In one embodiment the phosphorus-containing compounds comprise two or more (possibly up to four) non-ionic phosphorus compounds. Typically, the non-ionic phosphorus compound may have an oxidation of +3 or +5. The different embodiments comprise phosphite ester, phosphate esters, or mixtures thereof. In one embodiment the phosphorus-containing compound comprises a non-ionic phosphorus compound (a $C_{4-6}$ hydrocarbyl phosphite) and an amine salt of a phosphorus acid or ester.

In one embodiment, the phosphorus-containing compound comprises a non-ionic phosphorus compound that is a $C_{4-6}$ hydrocarbyl phosphite, or mixtures thereof. The $C_{4-6}$ hydrocarbyl phosphite includes those represented by the formula:

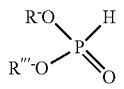

wherein each R''' may be independently hydrogen or a hydrocarbyl group having 4 to 6 carbon atoms, typically 4 carbon atoms, with the proviso that at least one of the R''' groups is hydrocarbyl. Typically, the $C_{4-6}$ hydrocarbyl phosphite comprises dibutyl phosphite.

The $C_{4-6}$ hydrocarbyl phosphite may deliver at least 175 ppm, or at least 200 ppm of the total amount of phosphorus delivered by the phosphorus-containing compounds.

The $C_{4-6}$ hydrocarbyl phosphite may deliver at least 45 wt %, or 50 wt % to 100 wt %, or 50 wt % to 90 wt % or 60 wt % to 80 wt % of the total amount of phosphorus from the phosphorus-containing compound.

The phosphorus-containing compounds may comprise a second phosphite whose formula is similar to that disclosed above, except R''' may contain 2 to 40, 8 to 24 or 11 to 20 carbon atoms, with the proviso that the second phosphite is not a $C_{4-6}$ hydrocarbyl phosphite. Examples of suitable hydrocarbyl groups include propyl, dodecyl, butadecyl, hexadecyl, octadecyl, propenyl, dodecenyl, butadecenyl, hexadeencyl, or octadecenylgroups.

As used herein the term "alk(en)yl" is intended to include moieties that have an alkyl and/or alkenyl group.

In one embodiment, the phosphorus-containing compounds include a mixture of a $C_{4-6}$ hydrocarbyl phosphite (typically dibutyl phosphite) and a $C_{12-18}$ alk(en)yl hydrogen phosphite and optionally phosphoric acid. In different embodiments the phosphoric acid is present or absent.

In one embodiment, the phosphorus-containing compounds include a mixture of a $C_{4-6}$ hydrocarbyl phosphite (typically dibutyl phosphite) and a $C_{16-18}$ alk(en)yl hydrogen phosphite. The alk(en)yl hydrogen phosphite be may an alkyl hydrogen phosphite, and alkenyl hydrogen phosphite, or a mixture of alkenyl hydrogen phosphite and alkyl hydrogen phosphite. In one embodiment the alk(en)yl hydrogen phosphite be may a mixture of alkenyl hydrogen phosphite and alkyl hydrogen phosphite and optionally phosphoric acid. The phosphoric acid may be present or absent.

In one embodiment, the phosphorus-containing compounds include a mixture of a $C_{4-6}$ hydrocarbyl phosphite (typically dibutyl phosphite) and a $C_{11-14}$ alk(en)yl hydrogen phosphite. The alk(en)yl hydrogen phosphite be may an alkyl hydrogen phosphite, and alkenyl hydrogen phosphite, or a mixture of alkenyl hydrogen phosphite and alkyl hydrogen phosphite. In one embodiment, the alk(en)yl hydrogen phosphite may be a mixture of alkenyl hydrogen phosphite and alkyl hydrogen phosphite and optionally phosphoric acid.

In one embodiment, the phosphorus-containing compounds include a mixture of a $C_{4-6}$ hydrocarbyl phosphite (typically dibutyl phosphite) and phosphoric acid. The lubricant composition in one embodiment includes a package that comprises a phosphorus-containing compound and a non-ionic phosphorus compound that is a hydrocarbyl phosphite.

In one embodiment, the composition further comprises a $C_{8-20}$ hydrocarbyl phosphite, or a $C_{12-18}$ hydrocarbyl phosphite, or $C_{11-18}$ hydrocarbyl phosphite, as described above.

In on embodiment, the amine salt of a phosphorus acid may be derived from an amine salt of a phosphate. The amine salt of the phosphorus acid may be represented by the formula:

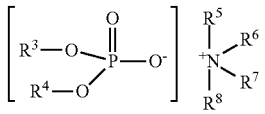

wherein $R^3$ and $R^4$ may be independently hydrogen or hydrocarbon typically containing 4 to 40, or 6 to 30, or 6 to 18, or 8 to 18 carbon atoms, with the proviso that at least one is a hydrocarbon group; and $R^5$, $R^6$, $R^7$ and $R^8$ may be independently hydrogen or a hydrocarbyl group, with the proviso that at least one is a hydrocarbyl group.

The hydrocarbon groups of $R^3$ and/or $R^4$ may be linear, branched, or cyclic.

Examples of a hydrocarbon group for $R^3$ and/or $R^4$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^3$ and/or $R^4$ include cyclopentyl, cyclohexyl, cycloheptyl, methylcyclopentyl, dimethylcyclopentyl, methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl.

In one embodiment, the phosphate may be an amine salt of a mixture of monoalkyl and dialkyl phosphoric acid esters. The monoalkyl and dialkyl groups may be linear or branched.

The amine salt of a phosphorus acid may be derived from an amine such as a primary amine, a secondary amine, a tertiary amine, or mixtures thereof. The amine may be aliphatic, or cyclic, aromatic or non-aromatic, typically aliphatic. In one embodiment the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Illinois), such as Armeen C, Armeen O, Armeen O L, Armeen T, Armeen H T, Armeen S and Armeen S D, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment, the amines are in the form of a mixture. Examples of suitable mixtures of amines include (i)

a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment, a suitable mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphorus acid may be prepared as is described in U.S. Pat. No. 6,468,946. Column 10, lines 15 to 63 describes phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphate hydrocarbon ester.

When present in a lubricating composition, the composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

Antioxidants:

Compositions prepared according to the instant disclosure may include at least one at least one antioxidant. Exemplary antioxidants useful herein include phenolic and aminic antioxidants, such as diarylamines, alkylated diarylamines, hindered phenols, and mixtures thereof. The diarylamine or alkylated diarylamine may be a phenyl-α-naphthylamine (PANA), an alkylated diphenylamine, an alkylated phenylnapthylamine, or mixture thereof. Example alkylated diphenylamines include dinonyl diphenylamine, nonyl diphenylamine, octyl diphenylamine, dioctyl diphenylamine, didecyl diphenylamine, decyl diphenylamine, and mixtures thereof. Example alkylated diarylamines include octyl, dioctyl, nonyl, dinonyl, decyl and didecyl phenylnapthylamines. Hindered phenol antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol. In one embodiment, the hindered phenol antioxidant may be an ester, such as those described in U.S. Pat. No. 6,559,105. One such hindered phenol ester is sold as Irganox™ L-135, obtainable from Ciba.

In one embodiment, a composition includes an amine antioxidant. The amine antioxidant may be a phenyl-α-naphthylamine (PANA) or a hydrocarbyl substituted diphenylamine, or mixtures thereof. The hydrocarbyl substituted diphenylamine may include mono- or di-$C_4$ to $C_{16}$-, or $C_6$ to $C_{12}$-, or $C_9$-alkyl diphenylamine. For example, the hydrocarbyl substituted diphenylamine may be octyl diphenylamine, or di-octyl diphenylamine, dinonyl diphenylamine, typically dinonyl diphenylamine.

The composition may, optionally, include at least one other antioxidant that is known and includes sulphurised olefins, hindered phenols, molybdenum dithiocarbamates, and mixtures thereof.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba, or butyl 3-(3,5-di-tert-butyl-4-hydroxyphenyl)propanoate.

Antioxidants may include diarylamine, alkylated diarylamines, hindered phenols, molybdenum compounds (such as molybdenum dithiocarbamates), hydroxyl thioethers, trimethyl polyquinoline (e.g., 1,2-dihydro-2,2,4-trimethylquinoline), or mixtures thereof.

The diarylamine or alkylated diarylamine may be a phenyl-α-naphthylamine (PANA), an alkylated diphenylamine, or an alkylated phenylnaphthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnaphthylamines. In one embodiment, the diphenylamine is alkylated with a benzene and t-butyl substituent.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from BASF GmbH. A more detailed description of suitable ester-containing hindered phenol anti-oxidant chemistry is found in U.S. Pat. No. 6,559,105.

Examples of molybdenum dithiocarbamates, which may be used as an antioxidants, include commercial materials sold under the trade names such as Molyvan 822®, Molyvan® A, Molyvan® 855 and from R. T. Vanderbilt Co., Ltd., and Adeka Sakura-Lube™ S100, S165, 5600 and S525, or mixtures thereof. An example of an ashless dithiocarbamate which may be used as an anti-oxidant or anti-wear agent is Vanlube® 7723 from R. T. Vanderbilt Co., Ltd.

The antioxidant may include a substituted hydrocarbyl mono-sulfide represented by the formula:

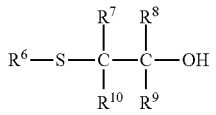

wherein $R^6$ may be a saturated or unsaturated branched or linear alkyl group with 8 to 20 carbon atoms; $R^7$, $R^8$, $R^9$ and $R^{10}$ are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol.

The amount of antioxidant if it is present, may be 0.01 to 5 or 3 wt % of the lubricating composition.

When present in a lubricating composition, the composition may include at least 0.1 wt. % or at least 0.5 wt. %, or at least 1 wt. % antioxidant, and in some embodiments, up to 3 wt. %, or up to 2.75 wt. %, or up to 2.5 wt. % antioxidant.

When present, an amine antioxidant may be present in a composition, such as a driveline composition, at 0.2 wt % to 1.2 wt %, or 0.3 wt % to 1.0 wt %, or 0.4 wt % to 0.9 wt % or 0.5 wt % to 0.8 wt %, of the composition. If present, the secondary antioxidant may be present at 0.1 wt % to 1 wt %, or 0.2 wt % to 0.9 wt % or 0.1 wt % to 0.4 wt %, or 0.4 wt % to 1.0 wt %, of the composition.

The lubricant may include an antioxidant, or mixtures thereof. The antioxidant may be present in an industrial composition at 0 wt % to 4.0 wt %, or 0.02 wt % to 3.0 wt 00 or 0.03 wt % to 1.5 wt % of the composition.

Extreme Pressure Agent:

A composition prepared according to the instant disclosure may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, a lubricating composition may include at least 0.01 wt. %, or at least 0.1 wt. %, or at least 0.5 wt. % or at least 3 wt % extreme pressure agent, and in some embodiments, up to 6 wt. %, or up to 3 wt. %. or up to 1 wt. % of the extreme pressure agent.

DRIVELINE: The polysulfide extreme pressure agent typically provides about 0.5 to about 5 wt % or about 1 to about 3 wt % of Sulphur to the lubricating composition.

Foam Inhibitors:

A composition prepared according to the instant disclosure may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Anti-foam agents, also known as foam inhibitors, are known in the art and include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. A particularly useful polyacrylate antifoam agent for fuels is the copolymer of tert-butyl acrylate and 3,3,5-trimethylhexyl acrylate and polymers of tert-butyl acrylate, 3,3,5-trimethylhexyl acrylate and poly(ethylene glycol) acrylate. In some embodiments the anti-foam is a polyacrylate. Another example of on non-silicone foam inhibitors include are polyacrylamides. In some embodiments, the polyacrylate can be a fluorinated polyacrylate.

ENGINE OILS: When the lubricating composition is for lubricating the crankcase of a spark ignited or compression ignited engine, the compositions disclosed herein can include an antifoam component in an amount of 0.05 wt % to 2 wt % or 0.1 wt % to 1.2 wt % or 0.2 wt % to 0.75 wt %.

DRIVELINE: In some embodiments, the compositions disclosed herein are lubricating compositions for driveline devices which can include an antifoam component in an amount of at least 50 ppm, or at least 100 ppm, or from 50 ppm to 1000 ppm, or from about 50 to about 500, or from 50 ppm to 450 ppm or 400 ppm of the overall composition on an oil free basis.

Corrosion/Rust Inhibitors/Metal Deactivators:

A composition prepared according to the instant disclosure may include a corrosion inhibitor. Corrosion inhibitors/metal deactivators that may be useful in the exemplary composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

The composition may also include a rust inhibitor. Suitable rust inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid, an ammonium sulfonate, an imidazoline, alkylated succinic acid derivatives reacted with alcohols or ethers, or any combination thereof; or mixtures thereof.

Suitable hydrocarbyl amine salts of alkylphosphoric acid may be represented by the following formula:

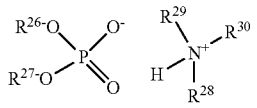

wherein $R^{26}$ and $R^{27}$ are independently hydrogen, alkyl chains or hydrocarbyl, typically at least one of $R^{26}$ and $R^{27}$ are hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment, the hydrocarbyl amine salt of an alkylphosphoric acid is the reaction product of a $C_{14}$ to $C_{18}$ alkylated phosphoric acid with Primene® 81R (produced and sold by Rohm & Haas) which is a mixture of $C_{11}$ to $C_{14}$ tertiary alkyl primary amines.

Hydrocarbyl amine salts of dialkyldithiophosphoric acid may include a rust inhibitor such as a hydrocarbyl amine salt of dialkyldithiophosphoric acid. These may be a reaction product of heptyl or octyl or nonyl dithiophosphoric acids with ethylene diamine, morpholine or Primene® 81R or mixtures thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid.

A composition may include a metal deactivator, or mixtures thereof. Metal deactivators may be chosen from derivatives of benzotriazole, 1,2,4-triazole, benzimidazole, 2-alkyldithiobenzimidazole, 2-alkyldithiobenzothiazole, or dimercaptothiadiazole. Examples of such derivatives include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole. The metal deactivators may also be described as corrosion inhibitors.

ENGINE OILS: The rust inhibitors may be present in a lubricating composition in the range from 0 to 2 wt % or 0.05 wt % to 2 wt %, from 0.1 wt % to 1.0 wt %, from 0.2 wt % to 0.5 wt %, of the lubricating oil composition. The rust inhibitors may be used alone or in mixtures thereof.

Pour Point Depressants:

A composition prepared according to the instant disclosure may include a pour point depressant. Pour point depressants that may be useful in the exemplary lubricating composition include polyalphaolefins, esters of maleic anhydride-styrene copolymers, polymethacrylates, polyacrylates, and polyacrylamides.

Pour point depressants are known in the art and include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

The Pour point depressants may be present in a lubricating composition in the range from 0.01 wt % to 2 wt % or 0.05 wt % to 1 wt % or 0.1 wt % to 0.6 wt % of the lubricating oil composition. The Pour point depressants may be used alone or in mixtures thereof.

Friction Modifiers:

A composition prepared according to the instant disclosure may include a friction modifier. Friction modifiers that may be useful in the exemplary composition include fatty acid derivatives such as amines, esters, epoxides, fatty imidazolines, condensation products of carboxylic acids and polyalkylene-polyamines and amine salts of alkylphosphoric acids. The friction modifier may be an ash-free friction modifier. Such friction modifiers are those which typically not produce any sulfated ash when subjected to the conditions of ASTM D 874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment, the ash-free friction modifier may be represented by the formula:

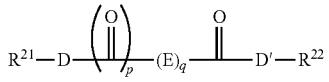

where, D and D' are independently selected from —O—, >NH, >$NR^{23}$, an imide group formed by taking together both D and D' groups and forming a $R^{21}$—N< group between two >C═O groups; E is selected from —$R^{24}$—O—$R^{25}$—, >$CH_2$, >$CHR^{26}$, >$CR^{26}R^{27}$, >C(OH)($CO_2R^{22}$), >C($CO_2R^{22}$)$_2$, and >$CHOR^{28}$; where $R^{24}$ and $R^{25}$ are independently selected from >$CH_2$, >$CHR^{26}$, >$CR^{26}R^{27}$, >C(OH)($CO_2R^{22}$), and >$CHOR^{28}$; q is 0 to 10, with the proviso that when q=1, E is not >$CH_2$, and when n=2, both Es are not >$CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, typically containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl) ester (i.e., di(2-ethylhexyl)tartrate), di($C_8$-$C_{10}$)tartrate, di($C_{12-15}$)tartrate, di-oleyltartrate, oleyltartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment, the friction modifier may be a long chain fatty acid ester. In another embodiment the long chain fatty acid ester may be a mono-ester and in another embodiment the long chain fatty acid ester may be a triglyceride.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{30}$ and $R^{31}$ is a hydrocarbyl group of 4 or more carbon atoms or represented by the formula:

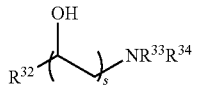

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, N-dococylmethylamine, N-beef tallow alkyl methylamine, N-hardened beef tallow alkyl methylamine, N-soybean oil alkyl methylamine, ditetradecylamine, dipentadecylamine, dihexadecylamine, distearylamine, dioleylamine, didococylamine, bis(2-hexyldecyl)amine, bis(2-octyldodecyl)amine, bis(2-decyltetradecyl)amine, beef tallow dialkylamine, hardened beef tallow dialkylamine, and soybean oil dialkylamine; and trialk(en)ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3$-$nH_2O$), molybdenum acid ($H_2MoO_4$), alkali metal molybdates ($Q_2MoO_4$) wherein Q represents an alkali metal such as sodium and potassium, ammonium molybdates $\{(NH_4)_2MoO_4$ or heptamolybdate $(NH_4)_6[Mo_7O_{24}]\cdot 4H_2O\}$, $MoOCl_4$, $MoO_2Cl_2$, $MoO_2Br_2$, $Mo_2O_3Cl_6$ and the like. Molybdenum trioxides or hydrates thereof, molybdenum acid, alkali metal molybdates and ammonium molybdates are often suitable because of their availability. In one embodiment, the lubricating composition comprises molybdenum amine compound.

Other organomolybdenum compounds suitable for use in the instant compositions may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylamino-ethylamine, octylaminopropylamine, octylaminoethylamine, dodecylaaminopropylaamine, dodecylaminoethylamine, hexadecylaminopropylamine, hexadecylaminoethylamine, octadecyl-aminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakuralube®710 available from Adeka which is a molybdenum amine compound, and Molyvan® 855, available from R. T. Vanderbilt.

In one embodiment, the friction modifier may be formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, 19-21. The friction modifier disclosed in U.S. Patent Application 60/725,360 may be an amide represented by the formula $R^1R^2N—C(O)R^3$, wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 68 and 69). In one embodiment the amide of a hydroxylalkyl compound is prepared by reacting glycolic acid, that is, hydroxyacetic acid, $HO—CH_2—COOH$ with an amine.

In one embodiment, the friction modifier may be a secondary or tertiary amine being represented by the formula $R^4R^5NR^6$, wherein $R^4$ and $R^5$ are each independently an alkyl group of at least 6 carbon atoms and $R^6$ is hydrogen, a hydrocarbyl group, a hydroxyl-containing alkyl group, or an amine-containing alkyl group. A more detailed description of the friction modifier is described in U.S. patent application Ser. No. 05/037,897 in paragraphs 8 and 19 to 22.

In one embodiment, the friction modifier may be derived from the reaction of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in International Publication WO04/007652) in paragraphs 8 and 9 to 14.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment, the friction modifier includes a fatty acid ester of glycerol. The final product may be in the form of a metal salt, an amide, an imidazoline, or mixtures thereof. The fatty acids may contain 6 to 24, or 8 to 18 carbon atoms. The fatty acids may be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid is oleic acid. When in the form of a metal salt, typically the metal includes zinc or calcium; and the products include overbased and non-overbased products. Examples are overbased calcium salts and basic oleic acid-zinc salt complexes which may be represented by the general formula $Zn_4Oleate_6O$. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier is the condensation product of a fatty acid with C8 to C24 atoms, and a polyalkylene polyamine, and in particular, the product of isostearic acid with tetraethylenepentamine.

In one embodiment, the friction modifier includes those formed by the condensation of the hydroxyalkyl compound with an acylating agent or an amine. A more detailed description of the hydroxyalkyl compound is described in WO 2007/0044820 paragraphs 9, and 20-22. The friction modifier disclosed in WO2007/044820 includes an amide represented by the formula $R^{12}R^{13}N—C(O)R^{14}$, wherein $R^{12}$ and $R^{13}$ are each independently hydrocarbyl groups of at least 6 carbon atoms and $R^{14}$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 72 and 73 of WO2007/044820). In one embodiment the amide of a hydroxylalkyl compound is prepared by reacting glycolic acid, that is, hydroxyacetic acid, $HO—CH_2—COOH$ with an amine.

In one embodiment, the friction modifier includes a reaction product of a di-cocoalkyl amine (or di-cocoamine) with glycolic acid. The friction modifier includes compounds prepared in Preparative Examples 1 and 2 of WO 2008/014319.

In one embodiment, the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier includes a hydroxyl amine compound as defined in column 37, line 19, to column 39, line 38 of U.S. Pat. No. 5,534,170. Optionally the hydroxyl amine includes borated as such products are described in column 39, line 39 to column 40 line 8 of U.S. Pat. No. 5,534,170.

In one embodiment, the friction modifier includes an alkoxylated amine e.g., an ethoxylated amine derived from 1.8% Ethomeen™ T-12 and 0.90% Tomah™ PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10] cocoamine); ETHOMEEN™ S/12 (bis[2-hydroxyethyl] soyamine); ETHOMEEN™ T/12 (bis[2-hydroxyethyl]-tallow-amine); ETHOMEEN™ T/15 (polyoxyethylene-[5] tallowamine); ETHOMEEN™ 0/12 (bis[2-hydroxyethyl] oleyl-amine); ETHOMEEN™ 18/12 (bis[2-hydroxyethyl] octadecylamine); and ETHOMEEN™ 18/25 (polyoxyethylene[15]octadecylamine). Fatty amines and ethoxylated fatty amines are also described in U.S. Pat. No. 4,741,848.

In one embodiment, the friction modifier includes a polyol ester as described in U.S. Pat. No. 5,750,476 column 8, line 40 to column 9, line 28.

In one embodiment the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment, the friction modifier includes a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment the friction modifier includes an alkylphosphonate mono- or di-ester sold commercially by Rhodia under the trademark Duraphos® DMODP.

The condensation of a fatty acid and a polyamine typically result in the formation of at least one compound chosen from hydrocarbyl amides, hydrocarbyl imidazolines and mixtures thereof. In one embodiment the condensation products are hydrocarbyl imidazolines. In one embodiment the condensation products are hydrocarbyl amides. In one embodiment the condensation products are mixtures of hydrocarbyl imidazolines and hydrocarbyl amides. Typically, the condensation product is a mixture of hydrocarbyl imidazolines and hydrocarbyl amides.

The fatty acid may be derived from a hydrocarbyl carboxylic acid. The hydrocarbyl group may be alkyl, cycloalkyl, or aryl, although alkyl is typical, and the hydrocarbyl groups may be linear or branched. Typically, the fatty acid contains 8 or more, 10 or more, more 13 or 14 or more carbon atoms (including the carbon of the carboxy group). Typically, the fatty acid contains 8 to 30, 12 to 24, or 16 to 18 carbon atoms. Other suitable carboxylic acids may include the polycarboxylic acids or carboxylic acids or anhydrides having from 2 to 4 carbonyl groups, typically 2. The polycarboxylic acids may include succinic acids and anhydrides and Diels-Alder reaction products of unsaturated monocarboxylic acids with unsaturated carboxylic acids (such as acrylic, methacrylic, maleic, fumaric, crotonic and itaconic acids). The fatty carboxylic acids include fatty monocarboxylic acids containing 8 to 30, 10 to 26, or 12 to 24 carbon atoms.

Examples of suitable fatty acids may include caprylic acid, capric acid, lauric acid, myristic acid, palmitic acid, stearic acid, eicosic acid and, tall oil acids. In one embodiment the fatty acid is stearic acid, which may be used alone or in combination with other fatty acids.

One or both friction modifiers may in one embodiment be nitrogen-containing compounds, typically both friction modifiers are nitrogen-containing.

In one embodiment one of friction modifiers is the condensation product of a fatty acid with C8 to C24 atoms, and a polyalkylene polyamine, and in particular, the product of isostearic acid with tetraethylenepentamine.

As used herein the term "fatty alkyl" or "fatty" in relation to friction modifiers means a carbon chain having 8 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

The amount of the ash-free friction modifier in a lubricant may be 0.1 to 3 percent by weight (or 0.12 to 1.2 or 0.15 to 0.8 percent by weight). The material may also be present in a concentrate, alone or with other additives and with a lesser amount of oil. In a concentrate, the amount of material may be two to ten times the above concentration amounts.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

The lubricant composition may include a friction modifier, typically at least two friction modifiers. Useful friction modifiers are described below. In one embodiment, a friction modifier is typically present at 0 to 4 wt %, or 0.1 to 4 wt %, 0.2 to 3 wt %, 0.3 to 3 wt %, 0.25 to 2.5 wt %. In one embodiment the friction modifier is present, and in an alternative embodiment the friction modifier is not present.

Demulsifiers:

A composition prepared according to the instant disclosure may include a demulsifier. Demulsifiers useful herein include trialkyl phosphates, and various polymers and copolymers of ethylene glycol, ethylene oxide, propylene oxide, and mixtures thereof.

Demulsifiers are known in the art and include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. In one embodiment, the demulsifier may be an oxyalkylated phenolic resin blend. Such a blend may comprise formaldehyde polymers with 4-nonylphenol, ethylene oxide and propylene oxide and formaldehyde polymers with 4-nonylphenol ethylene oxide. Demulsifiers may be present in the composition from 0.002 wt % to 0.012 wt %.

Seal Swell Agents:

Seal swell agents may also be included in a composition prepared according to the instant disclosure. Useful seal swell agents include sulfolene derivatives such as Exxon Necton-37™ (FN 1380) and Exxon Mineral Seal Oil™ (FN 3200).

Another useful seal swell agent is substituted sulfonyldibenzene compounds of formula:

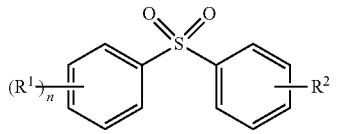

wherein: n is 0 or 1;

$R^1$ and $R^2$ are each independently a group represented by $R^3$ or $R^4{}_p$—Y;

$R^3$ is a hydrocarbyl group of about 4 or about 12 to about 20, about 6 to about 18, about 6 to about 14 or about 6 to about 8 carbon atoms;

$R^4$ is an alkylene group of about 1 or 2 carbon atoms; p is 0 or 1;

—Y is —Z—$R^5$ where —Z— is chosen from —H—, —N($R^6$)— where $R^6$ is a hydrocarbyl group of about from 6 to about 18 carbon atoms, —N═CH— —HC═N— —O—C(O)—, and —C(O)—O— and $R^5$ is hydrogen or an aliphatic hydrocarbyl group of about 4 or about 12 to about 20, about 6 to about 18, about 6 to about 14 or about 6 to about 8 carbon atoms; or —Y is represented by formula:

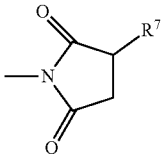

where $R^7$ is a hydrocarbyl group containing from about 8 to about 100, about 12 to about 24, about 8 to about 16, about 14 to about 16 or about 40 to about 70 carbon atoms.

In some embodiments, the lubricant prepared according to the instant process is formulated to lubricate a mechanical device. The mechanical device can be associated with an automotive vehicle such as, for example, a driveline device. Driveline devices include automatic transmissions, manual transmission, dual clutch transmissions, or an axle or differential.

A driveline device lubricating composition in different embodiments may have a composition as disclosed in the following table:

| | Embodiments (wt %) | | | |
|---|---|---|---|---|
| Additive | A | B | C | D |
| Polymeric surfactant compound | 1 to 20 | 2 to 15 | 2 to 10 | 5 to 10 |
| Other Dispersant | 1 to 4 | 0.1 to 10, 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 3, 0.025 to 2 | 0.5 to 6 | 0.01 to 2 |
| Antioxidant | 0 to 5 | 0.01 to 10 or 2 | 0 to 3 | 0 to 2 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 or 10 | 0 to 6 | 0 to 10 |
| Oil of Lubricating Viscosity | Balance to 100 % | | | |

Footnote:
The viscosity modifier in the table above may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

The mechanical device can be an internal combustion engine, such as, for example, a spark ignited internal combustion engine or a compression ignition internal combustion engine. An engine lubricant composition in different embodiments may have a composition as disclosed in the following table:

| | Embodiments (wt %) | | |
|---|---|---|---|
| Additive | A | B | C |
| Polymeric Surfactant compound | 0.1 to 5 | 0.25 to 4 | 0.5 to 2 |
| Corrosion Inhibitor | 0.05 to 2 | 0.1 to 1 | 0.2 to 0.5 |
| Other Overbased Detergent | 0 to 9 | 0.5 to 8 | 1 to 5 |
| Other Dispersant Viscosity Modifier | 0 to 5 | 0 to 4 | 0.05 to 2 |
| Other Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100 % | | |

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only and is not intended to be limiting.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure may be described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 wt. % refers to groups having 1, 2, or 3 wt. %. Similarly, a group having 1-5 wt. % refers to groups having 1, 2, 3, 4, or 5 wt. %, and so forth, including all points therebetween.

As used herein, the term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value.

Unless otherwise stated, "wt %" as used herein shall refer to the weight percent based on the total weight of the composition.

EXAMPLES

Methods for the preparation of the branched olefin copolymers the functionalization with the carboxylic acid moiety and subsequent reaction with an amine is well known and has been disclosed above. Illustrative examples of branched olefins, polymers, and polymeric surfactants are provided in the following Tables.

Branched Olefin

| Example # | Lower Olefin | Targeted # of lower olefin units in branched olefin | Level of Hydro-genation |
|---|---|---|---|
| 1 | Isoprene | 2-3 | None |
| 2 | Isoprene | 3-4 | None |
| 3 | Isoprene | 4-6 | None |
| 4 | Isoprene | 2-3 | Partial* |
| 5 | Isoprene | 3-4 | Partial* |
| 6 | Isoprene | 4-6 | Partial* |
| 7 | 3-methylbut-1-ene | 2-3 | None |
| 8 | 3-methylbut-1-ene | 4-6 | None |
| 9 | 2,7-dimethylocta-1,3,7-triene | 2-3 | None |
| 10 | 2,6-dimethylocta-1,3,7-triene | 2-3 | Partial* |
| 11 | 3,7-dimethylocta-1,3,7-triene | 2-3 | Partial* |
| 12 | 3,6-dimethylocta-1,3,7-triene | 2-3 | None |
| 13 | 2,7-dimethyloct-1-ene | 2-3 | None |
| 14 | 2,7-dimethyloct-1-ene | 2-3 | None |
| 15 | 2,6-dimethyloct-1-ene | 2-3 | None |
| 16 | 3,6-dimethyloct-1-ene | 2-3 | None |

*Partial = The Branched olefin copolymer is hydrogenated such that the branched polyolefin has about 1 olefin per mole of branched polyolefin.

Polymer

| Exam-ple # | Branched Polyolefin | Vinyl Monomer | Target Mn | Hydro-genated** |
|---|---|---|---|---|
| A | Example 1 | — | 500-750 | No |
| B | Example 1 | Styrene | 5000 | Yes |
| C | Example 3 | Styrene | 5000 | Yes |
| D | Example 3 | — | 2000 | Yes |
| E | Example 2 | — | 1000 | No |
| F | Example 1 | 1-dodecene | 5000 | Yes |
| G | Example 1 | 1-octadecene | 10000 | No |
| H | Example 3 | 1-hexene | 25000 | Yes |
| I | Example 3 | 1-decene | 500-750 | No |
| J | α-farnesene | — | 25000 | Yes |
| K | α-farnesene | 1-hexene | 25000 | Yes |
| L | α-farnesene | Styrene | 25000 | Yes |
| M | Example 4 | — | 1000 | No |
| N | Example 4 | 1-decene | 5000 | No |
| O | Example 4 | Styrene | 5000 | No |
| P | α-farnesene | — | 1000 | No |
| Q | α-farnesene | 1-hexene | 5000 | No |
| R | β-farnesene | 1-hexene | 5000 | Yes |
| S | β-farnesene | Styrene | 40000 | Yes |

-continued

| Example # | Branched Polyolefin | Vinyl Monomer | Target Mn | Hydrogenated** |
|---|---|---|---|---|
| T | β-farnesene | — | 2000 | Yes |
| U | β-farnesene | 1-decene | | No |
| V | α-farnesene/ β-farnesene | — | 500-750 | Yes |
| W | α-farnesene | — | 2000 | Yes |
| X | α-farnesene/ β-farnesene | 1-octadecene | 25000 | No |
| Y | α-farnesene/ β-farnesene | Styrene | 45000 | Yes |
| Z | α-farnesene/ β-farnesene | — | 1000 | No |

**Hydrogenated such that the polymer does not have any measurable unsaturation.

Polymeric Surfactant Compound

| Example # | Polymer | Carboxylic Acid | Functionalization method | COOH/1000 Mn olefin copolymer | Amine | COOH/ 1° amine |
|---|---|---|---|---|---|---|
| PSC 1 | A | MAA | Thermal | 0.5 | — | — |
| PSC 2 | A | MAA | Radical | 0.5 | DMAPA | 1:1 |
| PSC 3 | A | MAA | Radical | 0.5 | DPDA | 1:1 |
| PSC 4 | J | MAA | Radical | 0.5 | DPDA | 1:1 |
| PSC 5 | T | MAA | Radical | 1 | DMAPA | 1:1 |
| PSC 6 | L | MAA | Radical | 0.5 | DPDA | 1:1 |
| PSC 7 | M | MAA | Thermal | .5 | DMAPA | 1:1 |
| PSC 8 | M | MAA | Radical | 0.25 | APM | 1:1 |
| PSC 8 | M | MAA | Radical | 0.25 | — | 1:1 |
| PSC 9 | R | MAA | Radical | .5 | DMAPA | 1:1 |
| PSC 10 | S | MAA | Radical | 0.25 | DMAPA | 1:1 |
| PSC 11 | N | MAA | Thermal | .5 | APM | 1:1 |
| PSC 12 | W | MAA | Radical | 0.5 | APM | 1:1 |

DMAPA = dimethylaminopropylamine
DPDA = N,N-dimethylphenylenediamine
APM = aminopropylmorpholine
MAA = Maleic Anhydride

What is claimed is:

1. A lubricating oil composition comprising:

a. an oil of lubricating viscosity, and b. from 0.1 to 20 wt. % of a polymeric surfactant compound comprising a polymer represented by the formula $-[T]_n-[Z]_m-$, wherein T is a branched olefin containing 5 to 30 carbon atoms, Z is a vinyl monomer capable of polymerizing with the branched olefin, m is 0 to 100 and n is at least 1 when m=0 and wherein c carboxylic acid functionality is grafted onto the polymer to form the acylated polymer, and the polymer has a number average molecular weight (Mn) of 500 to 50,000 Da, wherein the branched olefin is a trimer of isoprene represented one of the following formulas;

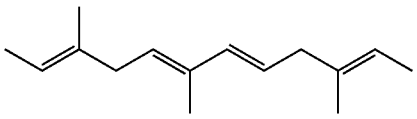

(2E,5B,7E,10E) 3,6,10-trimethyldodeca-2,5,7,10-tetraene, or

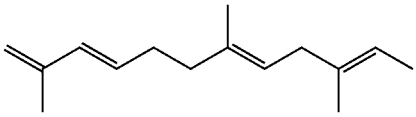

(3E,7E,10E)-2,7,10-trimethyldodeca-1,3,7,10-tetraene, or

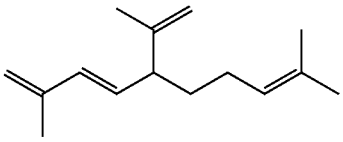

(E)-2,9-dimethyl-5-(prop-1-en-2-yl)deca-1,3,8-triene, or

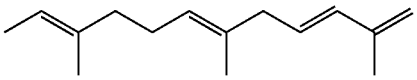

(3E,6E,10E)-2,6,10-trimethyldodeca-1,3,6,10-tretraene, of

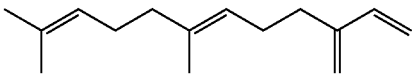

(E)-7,11-dimethyl-3-methylenedodeca-1,6,10-triene.

2. The lubricating composition of claim 1, where-in the carboxylic acid functionality of the acylated polymer is further reacted with an amine or alcohol to form an imide, amide, ester and combinations thereof.

3. The lubricating composition of claim 1, wherein the vinyl monomer is one or more of ethylene, α-olefin, and styrene.

4. The lubricating composition of claim 2, wherein the acylated polymer is reacted with an amine, wherein the amine comprises an aromatic amine, and wherein the aromatic amine is an N-arylphenylenediamine represented by the formula:

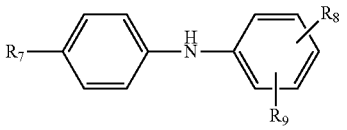

wherein, $R_7$ is H, —NHaryl, —NHalkaryl, or a branched or straight chain hydrocarbyl radical having from 4 to 24 carbon atoms being selected from an alkyl, an alkenyl, an alkoxyl, an aralkyl, or analkaryl;

$R_9$ is —$NH_2$, —$(NH(CH_2)_n)_m$ $NH_2$, —NHalkyl, —NHaralkyl, —CH2-aryl-NH2, in which n and m each have a value from 1 to 10; and $R_8$ is H, alkyl, alkenyl, alkoxyl, aralkyl, or alkaryl, having from 4 to 24 carbon atoms.

5. The lubricating composition of claim 2, wherein the acylated poymer is reacted with an amine or an alcohol, wherein the amine or alcohol is represented by the following formula:

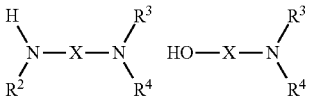

wherein,

X is an alkylene group containing about 1 to about 4 carbon atoms;

R2, R3 and R4 are each independently hydrocarbyl groups.

6. The lubricating composition of claim 1, wherein the composition further comprises one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof.

7. The lubricating composition of claim 1, wherein the composition contains no more than 2 wt % of a polyisobutylene based dispersant and no more than 1 wt % ethylene/propylene-based viscosity modifier dispersant.

8. The lubricating composition of claim 1, wherein the lubricating composition has a phosphorus content of 0.2 wt % or less and a total sulfated ash content of 2 wt % or less.

9. The lubricating composition of claim 1, wherein the lubricating composition is an engine oil having at least one of (i) a sulfur content of 0.5 wt % or less, (ii) a phosphorus content of 0.1 wt % or less, (iii) a sulfated ash content of 1.5 wt % or less, or combinations thereof.

10. The lubricating composition of claim 1, wherein the lubricating composition is a gear oil, wherein the lubricating composition further comprises one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the lubricating composition meets or exceeds the performance requirements of one or more of the following API Gear oil categories: API GL-4, GL-5, MIL-L-2105D, MIL-PRF-2105E, MT-1, and SAE Standard J2360.

11. The lubricating composition of claim 1, wherein the lubricating composition is an automatic transmission fluid, and wherein the lubricating composition further comprises one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the lubricating composition meets or exceeds the performance requirements of one or more of the following performance categories: DEXRON ULV, MERCON ULV, Mopar ATF+4, DEXRON III/MERCON, DEXRON VI/MERCON V, MERCON V—Most Ford, Mercury, Lincoln, Mazda B-Series, 2001-08 Mazda Tribute, MERCON LV, MERCON SP, Toyota ATF Type T-IV (T4), and Toyota ATF WS.

12. A method of operating an automatic transmission having a continuously variable transmissions (CVT), or an infinitely variable transmissions (IVT), or a Toroidal transmissions, or a continuously slipping torque converted clutches (CSTCC), or a stepped automatic transmissions or a dual clutch transmissions (DCT) said method comprising operating an automatic transmission with the lubricating composition of claim 1.

13. A method of operating an internal combustion engine fitted with a turbocharger, said method comprising operating the engine with the lubricating composition of claim 1.

14. A lubricating oil composition comprising:

a. an oil of lubricating viscosity, and b. from 0.1 to 20 wt. % of a polymeric surfactant compound comprising a polymer represented by the formula -$[T]_n$-$[Z]_m$—, wherein T is a branched olefin containing 5 to 30 carbon atoms, Z is a vinyl monomer capable of polymerizing with the branched olefin, m is 0 to 100 and n is at least 1 when m=0 and wherein the polymer reacted with an ethylenically unsaturated carboxylic acid to form the acylated polymer, and the polymer has a number average molecular weight (Mn) of 500 to 50,000 Da, wherein the branched olefin can be tetramers of the following formula:

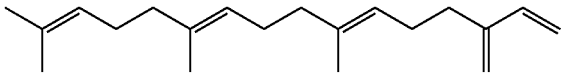

(6E,10E)-7,11,15-trimethyl-3-methylenehexadeca-1,6,10,14-tetraene, or

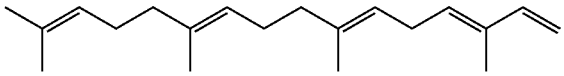

(3E,10E,14E)-3,7,11,15-tetramethylhexadeca-1,3,6,10,14-pentaene, or

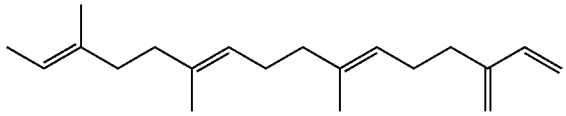

(6E,10E,14E)-7,11,14-trimethyl-3-methylenehexadeca-1,6,10,14-tetraene, or

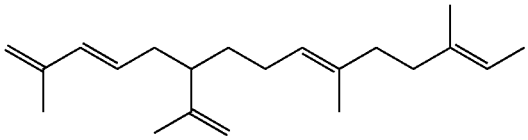

(6E,9E,13E)-2,10,13-trimethyl-6-(prop-1-en-2-yl)pentadeca-1,3,9,13-tetraene.

15. The lubricating composition of claim 14, wherein the carboxylic acid functionality of the acylated polymer is further reacted with an amine or alcohol to form an imide, amide, ester and combinations thereof.

16. The lubricating composition of claim 14, wherein the vinyl monomer is one or more of ethylene, an α-olefin, and styrene.

17. The lubricating composition of claim 15, wherein the acylated polymer is reacted with an amine, wherein the amine comprises an aromatic amine, and wherein the aromatic amine is an N-arylphenylenediamine represented by the formula:

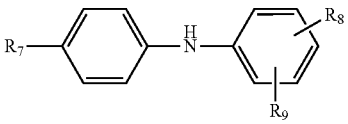

wherein, $R_7$ is H, —NHaryl, —NHalkaryl, or a branched or straight chain hydrocarbyl radical having from 4 to 24 carbon atoms being selected from an alkyl, an alkenyl, an alkoxyl, an aralkyl, or analkaryl;

$R_9$ is $—NH_2$, $—(NH(CH_2)_n)_m$ $NH_2$, —NHalkyl, —NHaralkyl, —CH2-aryl-NH2, in which n and m each have a value from 1 to 10; and R8 is H, alkyl, alkenyl, alkoxyl, aralkyl, or alkaryl, having from 4 to 24 carbon atoms.

18. The lubricating composition of claim 15, wherein the acylated polymer is reacted with an amine or alcohol, wherein the amine or alcohol is represented by the following formula:

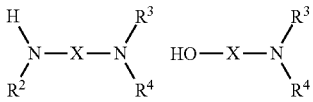

wherein,

X is an alkylene group containing about 1 to about 4 carbon atoms;

R2, R3 and R4 are each independently hydrocarbyl groups.

19. The lubricating composition of claim 14, wherein the composition further comprises one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof.

20. The lubricating composition of claim 14, wherein the composition contains no more than 2 wt % of a polyisobutylene based dispersant and no more than 1 wt % ethylene/propylene-based viscosity modifier dispersant.

21. The lubricating composition of claim 14, wherein the lubricating composition has a phosphorus content of 0.2 wt % or less and a total sulfated ash content of 2 wt % or less.

22. The lubricating composition of claim 14, wherein the lubricating composition is an engine oil having at least one of (i) a sulfur content of 0.5 wt % or less, (ii) a phosphorus content of 0.1 wt % or less, (iii) a sulfated ash content of 1.5 wt % or less, or combinations thereof.

23. The lubricating composition of claim 14, wherein the lubricating composition is a gear oil, wherein the lubricating composition further comprises one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the lubricating composition meets or exceeds the performance requirements of one or more of the following API Gear oil categories: API GL-4, GL-5, MIL-L-2105D, MIL-PRF-2105E, MT-1, and SAE Standard J2360.

24. The lubricating composition of claim 14, wherein the lubricating composition is an automatic transmission fluid, and wherein the lubricating composition further comprises one or more additives selected from the group consisting of anti-foaming agents, anti-wear agents, anti-oxidants, demulsifiers, detergents, dispersants, extreme pressure agents, friction modifiers, metal deactivators, pour point depressants, rust and corrosion inhibitors, viscosity modifiers, and combinations thereof, and the lubricating composition meets or exceeds the performance requirements of one or more of the following performance categories: DEXRON ULV, MERCON ULV, Mopar ATF+4, DEXRON III/MERCON, DEXRON VI/MERCON V, MERCON V—Most Ford, Mercury, Lincoln, Mazda B-Series, 2001-08 Mazda Tribute, MERCON LV, MERCON SP, Toyota ATF Type T-IV (T4), and Toyota ATF WS.

25. A method of operating an automatic transmission having a continuously variable transmissions (CVT), or an infinitely variable transmissions (IVT), or a Toroidal transmissions, or a continuously slipping torque converted clutches (CSTCC), or a stepped automatic transmissions or a dual clutch transmissions (DCT) said method comprising operating an automatic transmission with the lubricating composition of claim 14.

26. A method of operating an internal combustion engine fitted with a turbocharger, said method comprising operating the engine with the lubricating composition of claim 14.

* * * * *